US008554097B2

(12) United States Patent
Hara et al.

(10) Patent No.: US 8,554,097 B2
(45) Date of Patent: Oct. 8, 2013

(54) IMAGE HEATING APPARATUS

(75) Inventors: Nobuaki Hara, Abiko (JP); Osamu Okamoto, Moriya (JP); Kazuhisa Okuda, Tokyo (JP); Keisuke Mogi, Kashiwa (JP); Takeshi Fukuda, Nagareyama (JP); Ikuo Nakamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 492 days.

(21) Appl. No.: 12/783,009

(22) Filed: May 19, 2010

(65) Prior Publication Data

US 2010/0296828 A1 Nov. 25, 2010

(30) Foreign Application Priority Data

May 20, 2009 (JP) ..... 2009-121831

(51) Int. Cl.
*G03G 15/20* (2006.01)

(52) U.S. Cl.
USPC ..... 399/69; 399/122; 399/329

(58) Field of Classification Search
USPC ..... 399/38, 67–70, 122, 320, 328, 329; 219/219, 619
See application file for complete search history.

(56) References Cited

U.S. PATENT DOCUMENTS

| | | | | |
|---|---|---|---|---|
| 7,200,354 | B2 | 4/2007 | Nakamoto et al. | |
| 7,406,288 | B2 | 7/2008 | Nakamoto et al. | |
| 7,457,576 | B2 | 11/2008 | Takada et al. | |
| 7,466,950 | B2 | 12/2008 | Matsuura et al. | |
| 7,480,480 | B2 | 1/2009 | Endo et al. | |
| 7,505,725 | B2 | 3/2009 | Katayama et al. | |
| 7,542,711 | B2 | 6/2009 | Nakamoto et al. | |
| 7,546,078 | B2 | 6/2009 | Okuda et al. | |
| 7,596,348 | B2 | 9/2009 | Nakamoto et al. | |
| 7,693,435 | B2 * | 4/2010 | Moriguchi et al. | 399/33 |
| 8,254,819 | B2 | 8/2012 | Okamoto | |
| 8,358,960 | B2 | 1/2013 | Okamoto | |
| 2002/0118982 | A1 * | 8/2002 | Fuma | 399/329 |
| 2007/0231026 | A1 | 10/2007 | Hayashi et al. | |
| 2009/0208265 | A1 | 8/2009 | Nakamoto et al. | |
| 2010/0054786 | A1 | 3/2010 | Hara | |
| 2010/0129124 | A1 | 5/2010 | Hara | |
| 2011/0008083 | A1 | 1/2011 | Okamoto | |

FOREIGN PATENT DOCUMENTS

| | | |
|---|---|---|
| JP | 5-35138 | 2/1993 |
| JP | 2004-341346 | 12/2004 |

* cited by examiner

*Primary Examiner* — Hoan Tran
(74) *Attorney, Agent, or Firm* — Fitzpatrick, Cella, Harper & Scinto

(57) ABSTRACT

An image heating apparatus includes an image heater for heating an image on a recording material. The apparatus also includes a first temperature detecting member that detects a temperature of the image heating member, with the first temperature detecting member provided in a sheet processing region for a recording material of a minimum size. A controller is also provided for controlling electric power supply to the image heater on the basis of an output of the first temperature detecting member. Further provided is a second temperature detecting member is that is capable of detecting a temperature of the image heating member when the image heating member is contacted or is not contacted with a belt. A controller is also provided for controlling the image heating operation on the basis of the temperature of the image heating member.

12 Claims, 7 Drawing Sheets

(a)

(b)

(a)

(b)

(a)

(b)

IMAGE HEATING APPARATUS

FIELD OF THE INVENTION AND RELATED ART

The present invention relates to an image heating apparatus for heating an image on a recording medium. What can be listed as an image heating apparatus are a fixing apparatus for fixing an unfixed image on the recording medium, a glossiness increasing apparatus for increasing in glossiness an image fixed to the recording medium by heating the fixed image, and the like apparatuses. An image heating apparatus also includes an apparatus for quickly drying the ink of which an image is formed by an image forming apparatus of the inkjet or the like type, which forms images with the use of liquid which contains dyes and/or pigment.

An electrophotographic image forming apparatus such as an electrophotographic copying machine, a laser beam printer, etc., forms an electrostatic latent image on an electrophotographic photosensitive member, and develops this electrostatic image into a visible image (an image formed of toner, which hereafter will be referred to as toner image) with the use of a developing apparatus. The toner image is transferred onto a recording medium by a transferring apparatus. Then, the recording medium is conveyed through the heating nip (fixation nip) of a fixing apparatus which is an image heating apparatus. As the recording medium is conveyed through the fixation nip, heat and pressure are applied to the recording medium and the toner image thereon. As a result, the toner image becomes fixed (thermally fixed) to the recording medium. Typical fixing apparatuses are of the heat-roller type, or the heating-belt type. A fixing apparatus of the heat-roller type has a fixation roller and a pressure roller. The heat roller is an image heating member, and is heated by a halogen lamp as a heat-roller heating means. The pressure roller is a pressure-applying member, and forms the fixation nip by being placed in contact with the fixation roller. The toner image on the recording medium is thermally fixed to the recording medium by applying heat and pressure to the toner image on the recording medium by the fixation roller and pressure roller, respectively, while the recording medium is conveyed through the fixation nip, while remaining pinched by the fixation roller and the pressure roller (Japanese Laid-open Patent Application H05-35138). A fixing apparatus of the heating-belt type has a fixation belt and a pressure belt. The fixation belt is an image heating member, whereas the pressure belt is an image-pressing member. A fixing apparatus of the heating-belt type is structured so that the fixation belt and pressure belt oppose each other, and the unfixed toner image on the recording medium becomes fixed to the recording medium while the recording medium is conveyed through the interface between the fixation belt and the pressure belt while remaining pinched by the fixation belt and the pressure belt. A fixing apparatus of the heating-belt type is substantially greater in nip width than a fixing apparatus of the heat-roller type. Further, not only can the former more easily deal with the desire for size reduction, but also, the desire for an increase in operational speed, than the latter (Japanese Laid-open Patent Application 2004-341346). In the case of this fixing apparatus, its size and cost were reduced by using the minimum number (two) of rollers to suspend and keep stretched the belt. Since only two rollers were used to suspend and keep stretched the belt, the fixing apparatus was substantially smaller in overall thermal capacity, and therefore, was substantially shorter in the length of time necessary for the apparatus to reach the temperature level at which it can satisfactorily fix a toner image. Among fixing apparatuses of the heat-belt type, those of the electromagnetic induction heating type, that is, the fixing apparatuses which directly heat a heating medium, such as the heat belt, with Joule heat, that is, the heat generated by electromagnetic induction, have begun to attract attention as fixing apparatuses that reduce energy consumption. In the case of a fixing apparatus of the heat-roller type, its fixation roller is controlled in temperature. Thus, at least one temperature-detecting member A (main thermistor) is disposed as a main temperature-detecting member in the adjacencies of the peripheral surface of the fixation roller, or in contact with the peripheral surface of the fixation roller. The temperature of the fixation roller is controlled by controlling the power supply to the halogen lamp by the temperature-control circuit, based on the temperature of the fixation roller detected by the main temperature-detecting member A. On the other hand, in the case of a fixing apparatus of the heat-belt type, which uses electromagnetic induction to heat the belt, at least one temperature-detecting means is disposed in contact with, or in the adjacencies of, the outward or inward surface of the fixation belt, in order to control the temperature of the fixation belt. Thus, the temperature of the fixation belt is controlled by controlling the electric power supply to the induction coil, by the temperature-control circuit, based on the temperature of the fixation belt detected by the temperature-detecting means.

Generally, if the maximum size of the recording medium conveyable through the fixation nip of a fixing apparatus is A3, for example, recording media, whose sizes are B4, A4, A4, A5, A5, B5, B5, envelopes of the European type, post cards, etc., can also be conveyed through the fixation nip, in addition to the recording media of size A4. These sheets and envelopes, which are smaller in size than a recording sheet of size A4 will be referred to as a small recording sheet. In the case of fixing apparatuses such as the above-described one, it is a common practice to place their temperature-detecting means so that their positions correspond to the path of the smallest recording sheet, in order to ensure that the position of the temperature-detecting means will correspond to the position of the recording-sheet path regardless of the recording-sheet size. In a case where a recording sheet of the smallest size is used as a recording medium, heat accumulates in the portions of the fixation belt, which do not correspond in position to the recording-sheet path. This phenomenon that the fringe portions of the fixation belt increase in temperature has been problematic. More specifically, if a large sheet of recording media is conveyed through the fixation nip immediately after the portions of an image heating member that are outside the recording-medium path in terms of the widthwise direction of the image heating member are made extremely high in temperature by the continuous conveyance of a substantial number of small sheets of the recording media, the portions of the large sheet of the recording media, which correspond in position to the small recording-sheet path, are robbed of the toner thereon by the image heating member. In other words, the image heating member is contaminated by the toner. This problem is referred to as "hot offset". One of the solutions to this problem is to prevent an image forming apparatus from operating, until the portions of the image heating member, which correspond in position to the small recording-sheet path, are reduced in temperature to a level low enough for a large recording sheet to be used can be used for image formation without contaminating the image heating member. Known as another solution to the above-described problem is to employ an additional temperature-detecting means as a secondary temperature-detecting member B to detect the temperature of the portions of the image heating member, which are outside the small recording-sheet path in terms of the widthwise direction of the heating member, in order to reduce, as precisely as possible, the length of time the image forming apparatus (fixing apparatus) cannot be used after a substantial number of small recording sheets are continuously conveyed. A secondary temperature-detecting means, such as the above-described temperature-detecting means B, is for detecting the surface temperature of the image heating member, which corresponds in position to the portions of the path of a large recording sheet, which are outside the path of a small recording sheet. That is, the portions of the image heating member, the temperature of which is detected by the secondary temperature-detecting means, are the portions of the image heating member, which are in contact with the pressing member. Another method known as the solution to the above-described problem is to place a temperature-detecting means, as a secondary temperature-detecting means C, in such a position that makes it possible for the temperature-detecting means to detect the temperature of the portions of the image heating member, which will be highest in temperature when small recording sheets are continuously conveyed. This solution is thought of in consideration of the highest temperature which the image heating member can withstand, and the like factors. In other words, in the case of this solution, the operation of the image forming apparatus is interrupted in response to the temperature of the image heating member detected by the secondary temperature-detecting member C, or the image forming apparatus is reduced in the productivity if it is being used for an image forming operation in which small sheets of recording media are continuously conveyed as the recording mediums. In many cases, a secondary temperature-detecting means, such as the secondary temperature-detecting means C, is placed in the adjacencies of, or in contact with, one of the edge portions of the image heating member, with which the pressing member is not in contact.

However, the above-described solutions are problematic in that a fixing apparatus requires at least three temperature-detecting means, that is, the primary temperature-detecting member A, a secondary temperature-detecting means B, and a secondary temperature-detecting means C. Thus, the solution creates secondary problems in that it increases a fixing apparatus in cost and size. The present invention was made in consideration of these technical problems.

SUMMARY OF THE INVENTION

The primary object of the present invention is to decrease the number of temperature-detecting members provided in portions of an image heating apparatus (fixing apparatus that are not the nip-forming portions thereof that prevent these non-nip-forming portions from excessively increasing in temperature, thereby reducing the number of produced unsatisfactory images, the flaws of which are traceable to the abnormal temperature increase of the portions of the image heating members, which are not the nip-forming portions.

According to an aspect of the present invention, there is provided an image heating apparatus, comprising image heating means for heating an image on a recording material with heat, a belt member for forming a nip which nips and feeds the recording material by pressing the image heating means, a belt position adjusting means for adjusting a position of the belt member in the widthwise direction, a first temperature-detecting member which is provided in a sheet processing region for the recording material of a minimum size, and detects a temperature of the image heating member, a controller for controlling electric power supply to the image heating means on the basis of an output of the first temperature-detecting member, and a second temperature-detecting member, provided at an end of the image heating means, for detecting a temperature of the image heating means. The second temperature-detecting member is capable of detecting a temperature of the image heating member which is not in contact with the belt member when the belt is on one side with respect to the widthwise direction, and is capable of detecting a temperature of the image heating member which is in contact with the belt member when the belt member is on the side with respect to the widthwise. The apparatus also includes a controller for controlling the image heating operation at the time of the continuous image formation on the basis of the temperature of the image heating member which is not in contact with the belt member and for controlling a start operation of the image heating device on the basis of the temperature of the image heating member which is in contact with the belt member.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 1(*b*) is a schematic drawing of the fixation belts of the fixing apparatus in the first embodiment, and shows the laminar structure of the fixation belt.

FIG. 3(*d*) is a schematic drawing for illustrating the mechanism for controlling the positional deviation of the pressure belt in its widthwise direction.

FIG. 4(*b*) is a graph which shows the changes of the temperatures detected by the primary and secondary thermistors H1 and H2 respectively, when large sheets (A4 in size) of recording media were continuously conveyed through the fixation nip, while being positioned so that the long edges of the sheet of recording medium are perpendicular to the recording-medium conveyance direction.

FIG. 5(*b*) is a graph showing the changes of the temperatures measured by the primary and secondary thermistors H1 and H2, respectively, when small (A4) sheets of recording media were continuously conveyed through the fixation nip in such an attitude that its long edges are parallel to the recording-medium conveyance direction.

FIG. 6(*b*) is a graph which shows the changes of the temperatures measured by the primary and secondary thermistors H1 and H2, respectively, when small sheets of recording media were continuously conveyed through the fixation nip of the fixing apparatus in the second embodiment, that is, when recording sheets of size A4 are continuously conveyed in such an attitude that their long edges are parallel to the recording-medium conveyance direction.

FIG. 7(*b*) is a schematic drawing of the means for preventing the fixation belt from deviating in position without making the fixation belt move in an oscillatory manner, in the widthwise direction of the fixation belt. FIG. 7(*c*) is a schematic drawing for describing the pressure-belt deviation controlling means which is capable of moving the pressure belt in such an oscillatory manner that one of the edges of the pressure belt remains within range W1 or W2.

DETAILED DESCRIPTION OF THE PREFERRED EMBODIMENTS

Hereinafter, the present invention will be concretely described in regard to the fixing apparatuses (image heating apparatuses) in the following embodiments of the present invention. The following embodiments of the present invention are the preferred embodiments of the present invention. However, they are not intended to limit the present invention in scope to these embodiments. In other words, the present invention encompasses also embodiments of the present inventions which are different in structure from the following embodiments, as long as they are in accordance with the gist of the present invention.

<Image Forming Portion>

Figure 7:
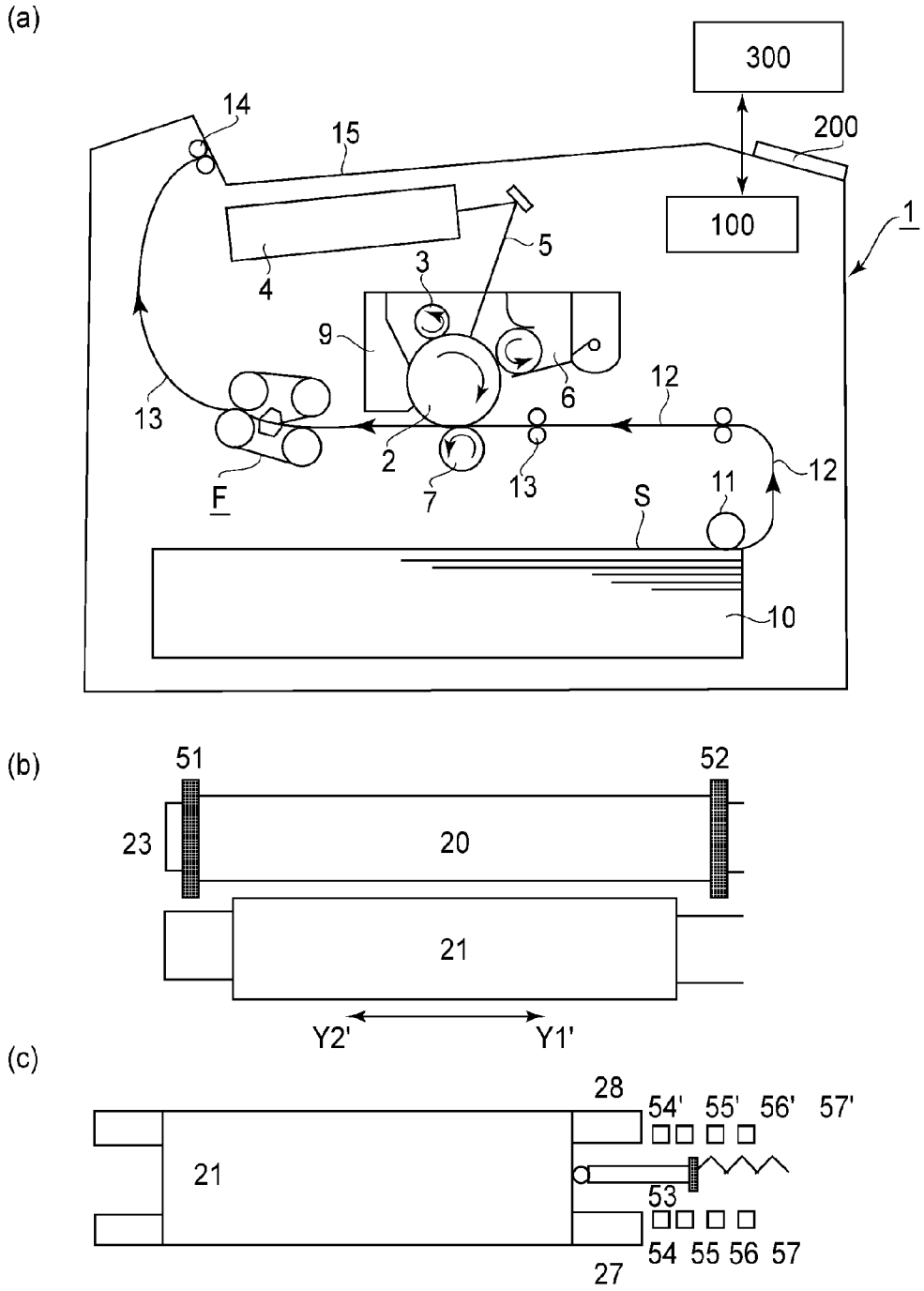
FIG. 7(*a*) is a schematic sectional view of an example of an image forming apparatus, whose fixing apparatus is an image heating apparatus in accordance with the present invention.

FIG. 7(*a*) is a schematic sectional view of an example of an image forming apparatus 1 whose fixing apparatus F is an image heating apparatus in accordance with the present invention. It shows the general structure of the image forming apparatus 1. This image forming apparatus 1 is an electrophotographic image forming apparatus, and more specifically, a laser printer. It is connected to an external host apparatus 300 such as a personal computer or the like. As electrical information of an image to be formed is inputted into its control circuit 100 (controlling means) from the external host apparatus 300, it outputs the information in the form of an image formed on a sheet S of a recording medium. Not only does the control circuit 100 exchange various electrical information with its control panel 200 and external host 300, but also, it integrally controls the image forming operation of the image forming apparatus 1 and the fixing operation of the fixing apparatus F, based on the preset control programs and reference tables. In other words, the image forming operations of the image forming apparatus 1 and the fixing operation of the fixing apparatus F, which will be described next, are controlled by the control circuit 100 of the image forming apparatus 1. This image forming apparatus 1 has an electrophotographic photosensitive drum 2 (which hereafter will be referred to as drum 2), which is a rotatable member for bearing a latent image. The drum 2 is rotationally driven at a preset speed (process speed) in the clockwise direction indicated by an arrow mark. As it is rotated, its peripheral surface is uniformly charged to a preset polarity and potential level by a charging device 3 functioning as a charging means. Then, the charged portion of the peripheral surface of the drum 2 is scanned by a beam of laser light which is emitted by a laser scanner 4 (exposing means) while being modulated with the information of an image to be formed. As a result, an electrostatic latent image, which reflects the information of an image to be formed, is formed across the exposed (scanned) portion of the peripheral surface of the drum 2. This electrostatic latent image is developed by a developing device 6 (developing means) into a visible image, that is, an image formed of toner (which hereafter will be referred to as a toner image). The toner image is transferred onto the sheet S of the recording medium in a transfer portion 8, which is the interface between the drum 2 and a transfer roller 7 (transferring means). More specifically, as the toner image and the sheet S of the recording medium are introduced into the transfer portion 8, the toner image is transferred onto the sheet S as if it is peeled away from the drum 2. Incidentally, before the sheet S of the recording medium is introduced into the transfer portion 8, it is in a sheet feeder cassette 10, which is in the bottom portion of the image forming apparatus 1; a substantial number of sheets S of recording media are stored in the sheet feeder cassette 10. As a sheet feeder roller 11 is driven with a preset sheet feeding timing, one of the sheets S of the recording media in the sheet feeder cassette 10 is separated from the rest, and reaches a pair of registration rollers 13 through a recording-medium conveyance passage 12. The pair of registration rollers 13 corrects the sheet S of the recording media by catching the sheet S by the leading edge of the sheet S. Then, the sheet S of the recording media (which hereafter will be referred to as the recording sheet S) is released by the pair of registration rollers 13 in synchronism with the movement of the toner image on the drum 2, that is, with such a timing that the leading edge of the recording sheet S reaches the transferring portion 8 at exactly the same time as the leading edge of the toner image on the drum 2 reaches the transferring portion 8. Then, the recording sheet S is conveyed through the transferring portion 8. As the recording sheet S is conveyed through the transferring portion 8, it is separated from the peripheral surface of the drum 2, starting from its leading edge. Then, it is conveyed to the fixing apparatus F. Then, the toner image on the recording sheet S, which is yet to be fixed, is solidly fixed to the surface of the recording sheet S by the heat and pressure applied to the recording sheet S and the toner image thereon, by the fixing apparatus F. Then, the recording sheet S is discharged by a pair of discharge rollers 14 into a delivery tray 15 through the recording-medium conveyance passage 13, so that it will be layered in the delivery tray 15. The delivery tray 15 is a part of the top wall of the image forming apparatus 1. After the separation of the recording sheet S from the peripheral surface of the drum 2, the peripheral surface is cleaned by a cleaning apparatus 9; the residual toner, that is, the toner remaining on the peripheral surface of the drum 2 after the toner image transfer, and the like adherents, on the peripheral surface of the drum 2 are removed by the cleaning apparatus 9. Then, the cleaned portion of the peripheral surface of the drum 2 is used again for image formation. That is, the peripheral surface of the drum 2 is repeatedly used for image formation.

<Fixing Apparatus (Image Heating Apparatus)>

Figure 1:
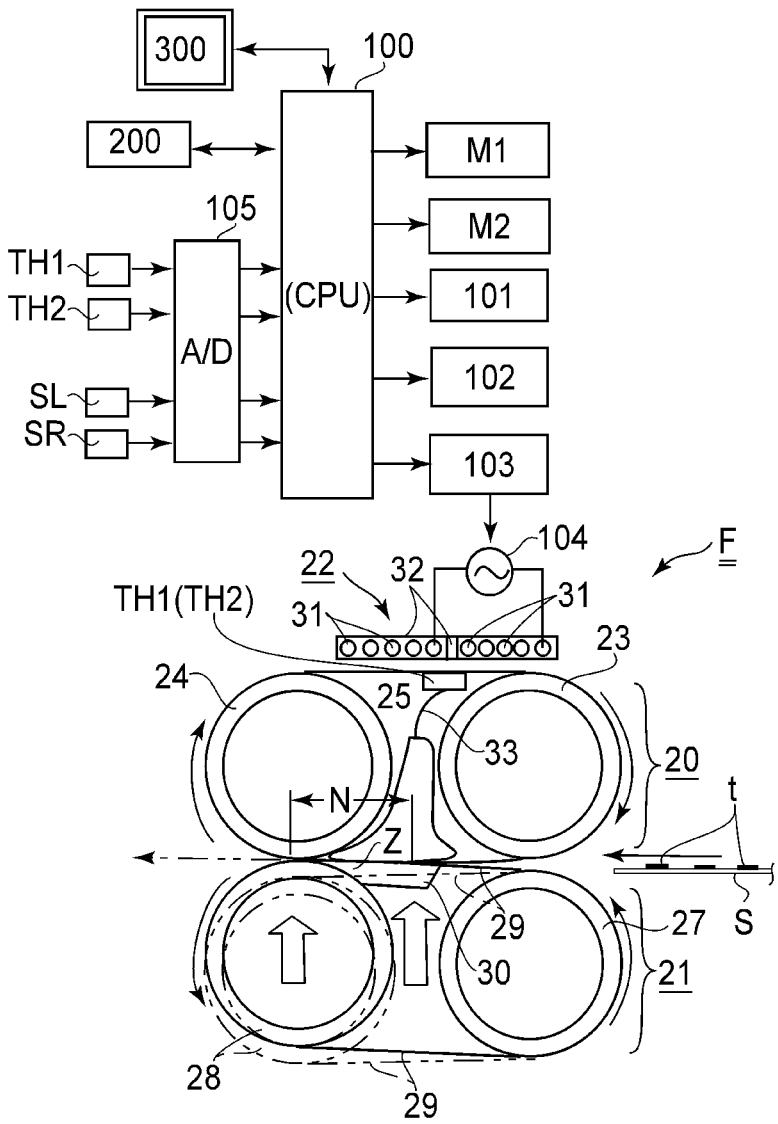
FIG. 1(*a*) is a combination of an enlarged cross-sectional view of the essential portions of the image heating apparatus as a fixing apparatus, and a block diagram of the control system of the image heating apparatus, in the first embodiment of the present invention.
Figure 1:
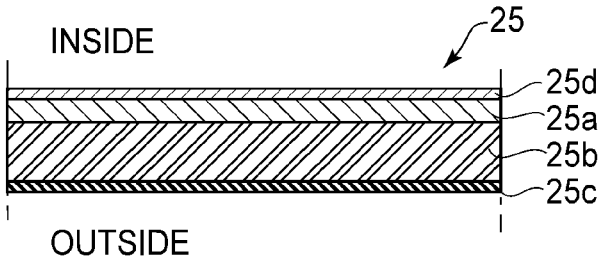

In the following description of the embodiments of the present invention, the "lengthwise direction" of the fixing apparatus F and any of the structural components of the fixing apparatus F is the direction perpendicular to the direction in which the recording sheet S is conveyed through the recording-medium conveyance passage of the fixing apparatus F. The front surface, or front side, of the fixing apparatus F is the surface, or side, of the fixing apparatus F, which has the recording medium entrance. The back surface, or back side, of the fixing apparatus F is the surface, or side, of the fixing apparatus F, which is opposite from the front surface, or front side, respectively, of the fixing apparatus F. The frontward direction is the rear-to-front direction of the fixing apparatus F, and the rearward direction is the front-to-rear direction of the fixing apparatus F. The left and right directions of the fixing apparatus are the left and right directions of the fixing apparatus F as seen from the front side of the apparatus F. The "upstream" and "downstream" directions are directions in terms of the recording-medium conveyance direction. The width of a sheet S of the recording media is the measurement of the sheet S in terms of the direction perpendicular to the recording-medium conveyance direction. FIG. 1(*a*) is a combination of an enlarged cross-sectional view of the essential portions of the image heating apparatus as a fixing apparatus, and a block diagram of the system for controlling the image heating apparatus, in the first embodiment of the present invention. This fixing apparatus F is of the belt type, and also, of the electromagnetic-induction heating type. It has: an image heating unit 20, which is an image heating means; an image pressing unit 21, which is an image pressing means; and an induction heating coil unit 22, which is a part of the image heating means, and is a heating means based on electromagnetic induction. The image heating unit 20 and the image pressing unit 21 are vertically stacked, the former being on top of the latter. The two units 20 and 21 form a heating nip, as a fixation nip N, by being pressed against each other. The induction coil unit 22 (exciter coil assembly) is above the image heating unit 20, and opposes the image heating unit 20.

(1) Image Heating Unit

The image heating unit 20 has a fixation-belt tensioning roller 23 and a fixation-belt driving roller 24, which are the first and second belt suspending members, respectively. The two rollers 23 and 24 are on the upstream and downstream sides, respectively, of the fixing apparatus F, in terms of the recording-medium conveyance direction. There are parallel to each other. The image heating unit 20 has also a fixation belt 25 as an image heating member. The fixation belt 25 is flexible and endless, and is suspended by the two rollers 23 and 24, being kept stretched between the two rollers 23 and 24. Further, the image heating unit 20 has a fixation pad 26, which is within the loop which the fixation belt 25 forms. The fixation pad 26 is in contact with the inward surface of the portion of the fixation belt 25, which corresponds in position to the bottom side of the abovementioned fixation belt loop. The fixation-belt tensioning roller 23, that is, the fixation-belt tensioning roller in this embodiment, is a hollow iron roller, and is 20 mm in external diameter and 18 mm in internal diameter. The fixation-belt driving roller 24 is a highly frictional elastic roller, which is made of a hollow metallic roller and an elastic layer. The hollow metallic roller is made of an iron alloy, and is 20 mm in external diameter and 18 mm in external diameter. The elastic layer is formed of a silicon rubber, and covers the entirety of the peripheral surface of the hollow metallic core. With the provision of this elastic layer, not only can the driving force inputted into the fixation-belt driving roller 24 through a gear train (unshown) from a fixation belt driving motor M1 be satisfactorily transmitted to the fixation belt 25, but also, it is ensured that as the recording sheet S comes out of the nip, the recording sheet S is separated from the fixation belt 25. The silicone rubber is 15 degrees (JIS-A) in hardness and 0.8 W/mK in thermal conductivity. Further, the provision of the silicone rubber layer (elastic layer) reduces the fixation-belt driving roller 24 in its inward heat conduction, being therefore effective to reduce the fixation-belt driving roller 24 in warm-up time.

Referring to FIG. 1(*b*) which is a schematic drawing for showing the laminar structure of the fixation belt 25, the fixation belt 25 is made up of a substrate layer 25*a* (a metallic layer, which is an electrically conductive layer, layer in which heat can be generated by electromagnetic induction) and an elastic layer 25*b*. The substrate layer 25*a* is a cylindrical member which is electrically molded of nickel. It is 40 mm in internal diameter, and is 70 nm in wall thickness. The elastic layer 25*b* covers the entirety of the peripheral surface of the substrate layer 25*a*, and is 300 nm in thickness. From the standpoint of the start-up speed of the fixing apparatus F, the substrate layer 25*a* is desired to be as thin as possible. However, in consideration of the efficiency with which the fixation belt 25 is heated by electromagnetic induction, it is necessary for the substrate layer 25*a* to have a certain amount of thickness. Thus, the thickness of the substrate layer 25*a* is desired to be in a range of 10-100 nm. On the other hand, from the standpoint of the start-up speed of the fixing apparatus, the elastic layer 25*b* is desired to as thin as possible. However, in order for the surface layer of the fixation belt 25 to be soft enough to allow the toner to be embedded in the surface layer so that the toner is effectively melted, the elastic layer 25*b* needs to have a certain amount of thickness. Thus, the thickness of the elastic layer 25*b* is desired to be in a range of 100-1,000 μm. As the material for the elastic layer 25*b*, any of known elastic substances may be used, for example, silicone rubber, fluorinated rubber, and the like. In this embodiment, silicone rubber, which is 20 degrees in hardness (JIS-A) and 0.8 W/mK in thermal conductivity, is used as the material for the elastic layer 25*b*. The deformation of the elastic layer 25*b* makes it possible to prevent the recording sheet S from wrapping around the fixation belt. That is, the deformation of the elastic layer 25*b* ensures that the recording sheet S separates from the fixation belt 25. In this embodiment, the fixation belt 25 has a parting layer 25*c* (slippery layer), which covers the entirety of the outward surface of the elastic layer 25*b*. The parting layer 25*c* is formed of fluorinated resin (PFA or PTFE, for example) and is 30 μm in thickness. The parting layer 25*c* may be made by covering the elastic layer 25*b* with a piece of PFA tube, or by coating the elastic layer 25*b* with PFA. The coating method can form a parting layer which is thinner than a parting layer formable by covering the elastic layer 25*b* with a piece of PFA tube. Further, a parting layer formed by the coating method allows toner to be more effectively embedded therein than a parting layer formed of a piece of PFA tube. In other words, a parting layer formed by the coating method is superior to a parting layer formed of a piece of PFA tube, in that the former is thinner and can allow toner be more effectively embedded therein than the latter. On the other hand, from the standpoint of mechanical and electrical strength, a parting layer formed of a piece of PFA tube is superior to a parting layer formed by the coating method. Thus, which method is to be used to form the parting layer 25 may be determined based on priority. More specifically, from the standpoint of conducting heat to the recording sheet S as much as possible, the parting layer 25*c* is desired to be as thin as possible. However, in consideration of the wear caused by mechanical friction, the parting layer 25*c* is desired to be 10-100 μm in thickness. In this embodiment, a piece of PFA tube, which was 30 μm in thickness, was used. Further, the fixation belt 25 in this embodiment had an inward layer 25*d*, which was on the inward surface of the substrate layer 25*a*. The inward layer 25*d* was formed of polyimide, and was 15 μm in thickness. The polyimide layer was provided to make the inward surface of the fixation belt 25 satisfactorily slippery. Thickness of the polyimide layer 25*d* affects the thermal responsiveness of the temperature-detecting members for detecting the temperature of the fixation belt 25 and the length of time it takes for the fixing apparatus F to start up. Therefore, the thickness of the polyimide layer 25*d* (inward layer) is desired to be in a range of 10-100 μm. The fixation pad 26 is in the adjacencies of the fixation-belt driving roller 24; it is not in contact with the fixation-belt driving roller 24. In this embodiment, the smallest distance (gap) between the fixation-belt driving roller 24 and fixation pad 26 is 3 mm. The fixation pad 26 is formed of an elastic substance, more specifically, heat resistant silicone rubber. It is 3 mm in thickness and 12 mm in width. In order to minimize the friction between the fixation pad 26 and inward surface of the fixation belt 25, the surface of the fixation pad 26 is covered with a piece of a low friction sheet made of a layer of glass fiber cloth and a layer of fluorinated resin coated on the glass fiber layer. This fixation pad cover reduces the amount of torque necessary to drive the fixation-belt driving roller 24. Therefore, the fixation belt 25 can be reliably rotated without employing a large motor.

(2) Image Pressing Unit

The image pressing unit 21 has a pressure-belt tensioning roller 27 and a pressure-belt driving roller 28, which are the first and second belt suspending members, respectively. The two rollers 27 and 28 are on the upstream and downstream sides, respectively, of the fixing apparatus F, in terms of the recording-medium conveyance direction. They are parallel to each other. The image pressing unit 21 has also a pressure belt 29 as a pressing member. The pressure belt 29 is flexible and endless, and is suspended by the two rollers 27 and 28, being kept stretched between the two rollers 27 and 28. Further, the image pressing unit 21 has a pressure pad 30, which is within the loop which the pressure belt 29 forms. The pressure pad 30 is in contact with the inward surface of the portion of the pressure belt 29, which corresponds in position to the top side of the abovementioned pressure belt loop. It is kept pressed upward by a pressure applying member (unshown). The pressure-belt tensioning roller 27 is made of a metallic core and a silicon sponge layer. The metallic core is a piece of a hollow cylinder made of iron alloy. It is 20 mm in external diameter and 16 mm in internal diameter. The silicone sponge layer is placed on the peripheral surface of the metallic core, covering the entirety of the peripheral surface of the metallic core. It is for minimizing the heat conduction from the pressure belt 29 to the pressure-belt tensioning roller 27, by reducing the pressure-belt tensioning roller 27 in thermal conduction. The pressure-belt driving roller 28 is a hollow rigid roller made of iron alloy. It is 20 mm in external diameter and 16 mm in internal diameter. It is frictional. The pressure belt 29 is made up of a substrate layer and a parting layer (slippery layer). The substrate layer is a cylindrical member made of nickel. It is 40 mm in internal diameter, and is 75 μm in wall thickness. The parting layer, that is, the surface layer, covers the entirety of the peripheral surface of the metallic core, and is 30 μm in thickness. It is a piece of PFA (fluorinated resin) tube. The pressure pad 30 is in contact with the pressure-belt driving roller 28. More specifically, in order to make the fixation nip N uniform in pressure, that is, in order to ensure that no point (area) in the fixation nip N is lower in pressure than the rest, the pressure pad 30 is positioned so that its downstream edge is wedged in a wedge-shaped space Z between the inward surface of the pressure belt 29 and the peripheral surface of the pressure-belt driving roller 28. That is, the pressure pad 30 (more specifically, pressure pad cover) is in contact with the pressure-belt driving roller 28. The pressure pad 30 is made of an elastic substance, more specifically, heat resistant silicone rubber. It is 3 mm in thickness and 15 mm in width. Incidentally, a piece of wire may be embedded across the entirety of the portion of the pressure pad 30, which corresponds in position to the wedge-shaped space Z between the inward surface of the pressure belt 29 and the peripheral surface of the pressure-belt driving roller 28. More concretely, the wire is fixed to the abovementioned heat-resistant, silicone-rubber layer. With the placement of the wire in the abovementioned portion of the pressure pad 30, it is further ensured that the nip pressure does not fall in the area corresponding to the space Z. In this case, the pressure pad 30 is structured so that the wire is covered with the low friction cover, along with the abovementioned silicone rubber. In order to minimize the friction which occurs between the pressure pad 30 and the inward surface of the pressure belt 29 as the pressure belt 29 slides on the pressure pad 30, and the friction which occurs between the pressure pad 30 and the pressure-belt driving roller 28 as the pressure-belt driving roller 28 rotates, the pressure pad 30 is covered, like the fixation pad 26, with a low friction sheet, for example, a polyimide sheet coated with fluorinated resin, or a glass fiber cloth coated with fluorinated resin.

(3) Induction Heating Coil Unit

In this embodiment, the fixing apparatus F has an induction heating coil unit 22, which is a part of the image heating means for causing the image heating member to generate heat. The induction heating coil unit 22 has an exciter coil 31 and a magnetic core 32. The exciter coil 31 is connected to a driving circuit 103 (high frequency converter) for electromagnetic induction, and is supplied with 10-2,000 [kW] of high frequency electric power by an AC electric power source 104. Thus, for the purpose of making the surface area of the exciter coil 31 as large as possible to prevent the temperature increase of the exciter coil 31, it is made of multiple intertwined strands of wire coated with enamel; it is formed of the so-called Litz wire. It is coated with a heat resistance substance. As the material for the magnetic core 32, a substance which is high in magnetic permeability and low in loss is used. The core 32 is employed to increase the magnetic circuit in efficiency, and to the block magnetic field. A typical material for the core 32 is ferrite. The magnetic field generated by the induction heating coil unit 22 causes the substrate layer 25*a* (nickel layer) of the fixation belt 25 to generate an ebb current, with which the fixation belt 25 is heated. That is, the fixation belt 25 is heated by electromagnetic induction.

(4) Mechanism for Moving Image Pressing Unit 21

The image pressing unit 21 is vertically movable relative to the image heating unit 20 by an image pressing unit moving mechanism 101, which is controlled by the control circuit 100. The image pressing unit 21 is pressed upon the image heating unit 20, generating a preset amount of contact pressure between the two units 20 and 21, by being moved upward as indicated (contoured) by a solid line. Further, the image pressing unit 21 is separated from the image heating unit 20, being prevented from applying pressure to the image heating unit 20, by being moved downward as indicated (contoured) by a double-dot chain line. When the image pressing unit 21 is in its uppermost position, the pressure-belt driving roller 28 presses on the fixation-belt driving roller 24 with the presence of the pressure belt 29 and fixation belt 25 between the two rollers 28 and 24. Further, the pressure pad 30 is kept pressed upward by the pad pressing member. Therefore, the pressure pad 30 is kept pressed against the fixation pad 26 with the presence of the pressure belt 29 and fixation belt 25 between the two pads 30 and 26. Thus, when the image pressing unit 21 is in its uppermost position, the pressure belt 29 of the image pressing unit 21 is kept pressed upon the fixation belt 25 of the image heating unit 20, forming thereby the fixation nip N, which is substantially greater in width, in terms of the recording-medium conveyance direction, than a fixation nip formed by only a fixation roller and a pressure roller. Although the structure of the image pressing unit moving mechanism 101 is not precisely illustrated in the drawing, the mechanism 101 may be an elevating mechanism or the like employing a cam connected to an electromagnetic switch (solenoid), a motor, etc. The control circuit 100 controls the image heating unit moving mechanism 101 so that when the image forming apparatus 1 is not performing a printing operation (image forming operation), that is, when the apparatus 1 is on standby, the image pressing unit 21 is in the position in which it does not apply pressure to the image heating unit 20. As an image begins to be actually formed (during actual image formation), the control circuit 100 controls the image pressing unit mechanism 101 so that the image pressing unit 21 is pressed upon the image heating unit 20 before the recording sheet S is inserted into the fixing apparatus F.

(5) Image Fixing Operation

The control circuit 100 controls the image pressing unit moving mechanism 101 so that when the image forming apparatus 1 is kept on standby, the image pressing unit 21 is in the position in which it does not contact the image heating unit 20. More specifically, when the image forming apparatus 1 is kept on standby, the control circuit 100 keeps the fixation belt driving motor M1 turned on. Thus, driving force is transmitted to the fixation-belt driving roller 24 from the fixation belt driving motor M1 through the gear train (unshown), whereby the fixation-belt driving roller 24 is rotated at a preset speed in the clockwise direction indicated by an arrow mark. By this rotation of the fixation-belt driving roller 24, the fixation belt 25 and the fixation-belt tensioning roller 23 are rotationally driven in the same direction. More specifically, the fixation belt 25 is rotated by the rotation of the fixation-belt driving roller 24 because of the presence of friction between the silicone rubber surface of the fixation-belt driving roller 24 and the inward polyimide layer surface of the fixation belt 25. Further, the control circuit 100 supplies the exciter coil 31 of the induction heating coil unit 22 with high frequency electric power from the AC power source 104 by turning on the electromagnetic induction heating coil unit driving circuit 103. Thus, the fixation belt 25, which is being rotationally driven, is heated by electromagnetic induction, increasing thereby in temperature. The temperature of the fixation belt 25 is detected by a primary thermistor TH1, which is the first temperature-detecting member for detecting the temperature of the portion of the fixation belt 25, which corresponds in position to the recording-sheet path. Then, the information (electrical signals) regarding the temperature of the fixation belt 25 detected by the primary thermistor TH1, that is, the temperature of the portion of the fixation belt 25, which corresponds in position to the recording-sheet path, is inputted into the control circuit 100 by way of an A/D (analog/digital) converter. Then, the control circuit 100 controls the temperature of the fixation belt 25 by controlling the electric power supply to the exciter coil 31 so that the information regarding the detected temperature, which is inputted from the primary thermistor TH1 to the control circuit 100, matches the information regarding a preset level (preset temperature level for properly heating image). Further, the control circuit 100 keeps a pressure belt driving motor M2 turned on. Therefore, the driving force from the pressure belt driving motor M2 is transmitted to the pressure-belt driving roller 28 through a gear train (unshown), whereby the pressure-belt driving roller 28 is rotated in the counterclockwise direction indicated by an arrow mark at a preset speed. By this rotation of the pressure-belt driving roller 28, the pressure belt 29 and the pressure-belt tensioning roller 27 are rotationally driven in the same direction. As described above, when the image forming apparatus 1 is on standby, the fixing apparatus F is kept in such a state that the image pressing unit 21 is kept in the position in which it is not in contact with the image heating unit 20; the fixation belt 25 is being rotationally driven; the fixation belt 25 is heated and its temperature is kept at the preset level for fixation; and the pressure belt 29 is being rotationally driven.

The primary thermistor TH1 is kept pressed against the fixation pad 26 with the presence of an elastic supporting member 33. Therefore, the temperature detection surface of the primary thermistor TH1 is always kept in contact with the inward surface of the fixation belt 25 by the elasticity of the elastic supporting member 33. The fixing apparatus F in this embodiment has a secondary thermistor TH2 as the secondary temperature-detecting member, in addition to the primary thermistor TH1. This secondary thermistor TH2 also is kept pressed against the fixation pad 26 with the presence of an elastic supporting member 33. Therefore, the temperature detection surface of the secondary thermistor TH2 is always kept in contact with the inward surface of the fixation belt 25 by the elasticity of the elastic supporting member 33. The details of the primary and secondary thermistors TH1 and TH2, respectively, and their precise positions and functions, will be described later. As a print start signal is inputted, the control circuit 100 controls the image pressing unit moving mechanism 101 so that the image pressing unit 21 is moved into the position in which it presses upon the image fixing unit 20 before the recording sheet S is inserted into the fixing apparatus F. Then, the recording sheet S having an unfixed toner image t is introduced into the fixation nip N, with its surface having the unfixed toner image t facing the fixation belt 25. Then, the recording sheet S is conveyed through the fixation nip N, remaining pinched between the fixation belt 25 and pressure belt 29. As the recording sheet S is conveyed through the fixation nip N, the unfixed toner image t is permanently fixed to the surface of the recording sheet S by the heat from the fixation belt 25 and the nip pressure. As soon as a printing job in which a single copy is to be made, or a preset number of copies are to be continuously made, is completed, the control circuit 100 puts the image forming apparatus 1 on standby, and waits for the inputting of the signal for starting the next printing job. While the image forming apparatus 1 is kept on standby, the image pressing unit 21 of the fixing apparatus F is kept separated from the image heating unit 20 of the fixing apparatus F. Also during this period, the fixation belt 25 is continuously rotated while being heated so that its temperature remains at a preset level. Further, the pressure belt 29 also is continuously rotated. However, with the elapse of a preset length of time the image forming apparatus 1 is to be kept on standby, the control circuit 100 puts the image forming apparatus 1 to sleep. While the image forming apparatus is kept asleep, the electric power is not supplied to the inducting heating coil unit 22, and the fixation belt driving motor M1 and pressure belt driving motor M2 are not driven. As soon as a print start signal is inputted while the image forming apparatus is kept asleep, the control circuit 100 puts the image forming apparatus 1 on standby; begins driving fixation belt driving motor M1 and pressure belt driving motor M2; and begins to supply the induction heating coil unit 22 with electric power.

(6) Belt Deviation Control Mechanism

Next, the belt deviation control mechanism will be described. The belt deviation control mechanism is a means for adjusting a belt (fixation belt and/or pressure belt) in position to prevent the problem that as a fixing apparatus of the belt type is driven, the belt deviates in position (belts shifts in direction parallel to axial line of belt supporting member), which results in the damage to the edge portions of the belt, or complete breakage of the belt. Incidentally, the direction of the axial line of the belt supporting member is the same as the width direction of the belt, and is perpendicular to the recording-medium conveyance direction.

Figure 2:
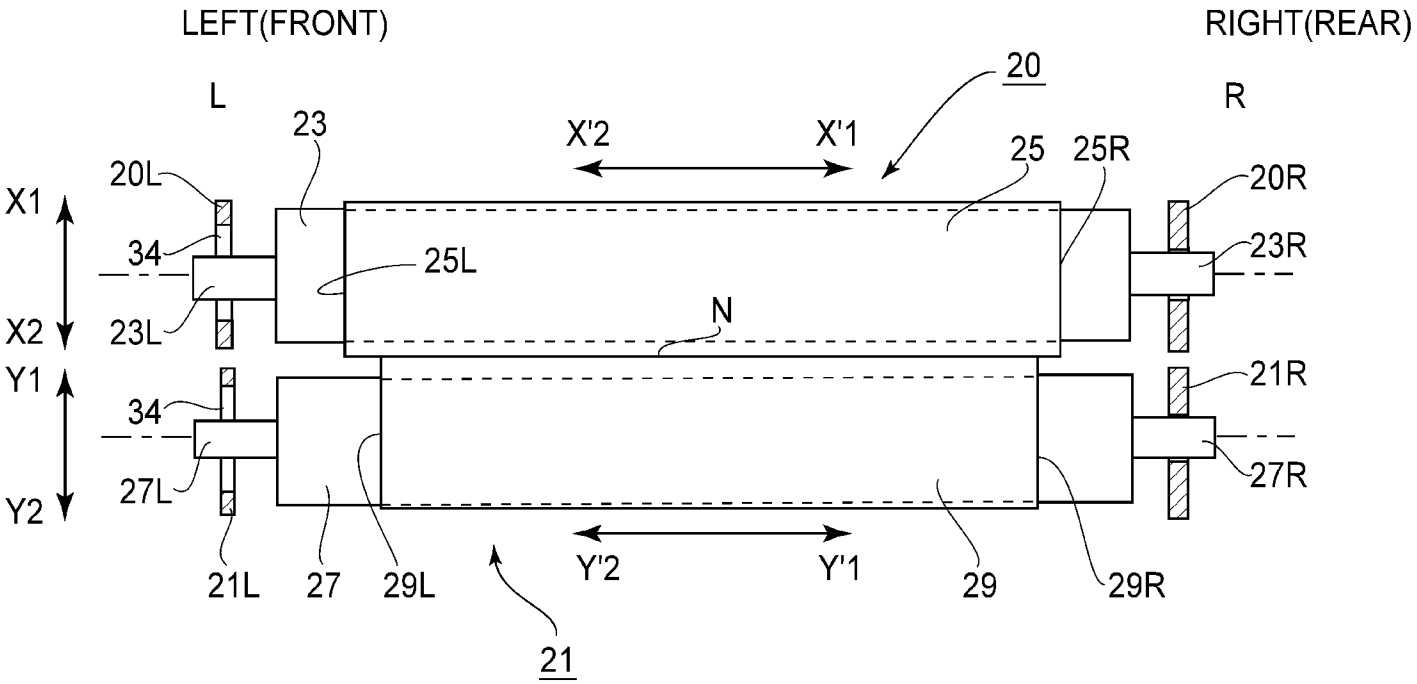
FIG. 2 is a plan view of the image heating unit and the image pressing unit of the fixing apparatus shown in FIG. 1, as seen from the front side (recording medium entrance side) of the apparatus.

Generally, the belt deviation control mechanism is structured so that it can change one of multiple belt supporting members in attitude to change the belt supporting member in the attitude relative to the other belt supporting members. Belt deviation control mechanisms which use this structure arrangement to control the positional (lateral) deviation of a belt which occurs during the rotation of the belt have been put to practical use. To described more concretely the working of a typical belt deviation control mechanism of the above-described type, a belt is prevented from excessively shift in position, by changing the alignment between at least one of the multiple rollers as belt suspending members and the rest by changing the roller in attitude by tilting the roller in such a manner that one end of the roller is not changed in position. FIG. 2 is a schematic front view (as seen from side from which recording sheet S is introduced) of the image heating unit 20 and image pressing unit 21 of the fixing apparatus F shown in FIG. 1(*a*). The right-hand ends 23R and 27R (rear ends) of the fixation-belt tensioning roller 23 and pressure application tension roller 27 are supported by the right-hand metallic plates 20R and 21R of the units 20 and 21, respectively, in such a manner that they can be rotated and also, that the fixation-belt tensioning roller 23 and the pressure-belt tensioning roller 27 can be tilted. The left-hand ends 23R and 27L (front ends; left ends of roller shafts) of the fixation-belt tensioning roller 23 and the pressure application tension roller 27 are supported by the left metallic plates 20L and 21L in such a manner that they can be rotated, and also that they vertically moved along the elongated vertical holes 34 with which each of the left-hand metallic plates 20L and 21L is provided. Thus, the position of the fixation belt 25 relative to the fixation-belt tensioning roller 23 in terms of the lengthwise direction of the fixation-belt tensioning roller 23 can be changed in the X'1 direction or X'2 direction by tilting the fixation-belt tensioning roller 23 in such a manner that the left-hand end 23L of the shaft of the fixation-belt tensioning roller 23 is in the upward direction X1 indicated by an arrow mark, or downward direction X2 indicated by an arrow mark. Further, the position of the pressure belt 29 relative to the pressure-belt tensioning roller 27 in terms of the lengthwise direction of the pressure belt 29 can be changed in the Y'1 direction or Y'2 direction indicated by arrow marks, by tilting the pressure-belt tensioning roller 27 in such a manner that the left-hand end 27L of the shaft of the pressure-belt tensioning roller 27 moves in the upward direction Y1 or downward direction Y2 indicated by arrow marks, respectively. More specifically, as the fixation-belt tensioning roller 23 is tilted in such a manner that the left-hand end of its shaft moves in the X1 direction, the fixation belt 25 moves in the direction X'1, whereas as it is tilted in such a manner that the left-hand end of its shaft moves in the X2 direction, the fixation belt 25 moves in the direction X'2. Thus, the lateral deviation of the fixation belt 25 can be controlled by controlling the attitude (tilting) of the fixation-belt tensioning roller 23. Similarly, as the pressure-belt tensioning roller 27 is tilted in such a manner that the left-hand end of its shaft moves in the Y1 direction, the pressure belt 29 moves in the direction Y'1, whereas as it is tilted in such a manner that the left-hand end of its shaft moves in the Y2 direction, the pressure belt 29 moves in the direction Y'2. Thus, the lateral deviation of the pressure belt 29 can be controlled by controlling the attitude (tilting) of the pressure-belt tensioning roller 27.

Figure 3:
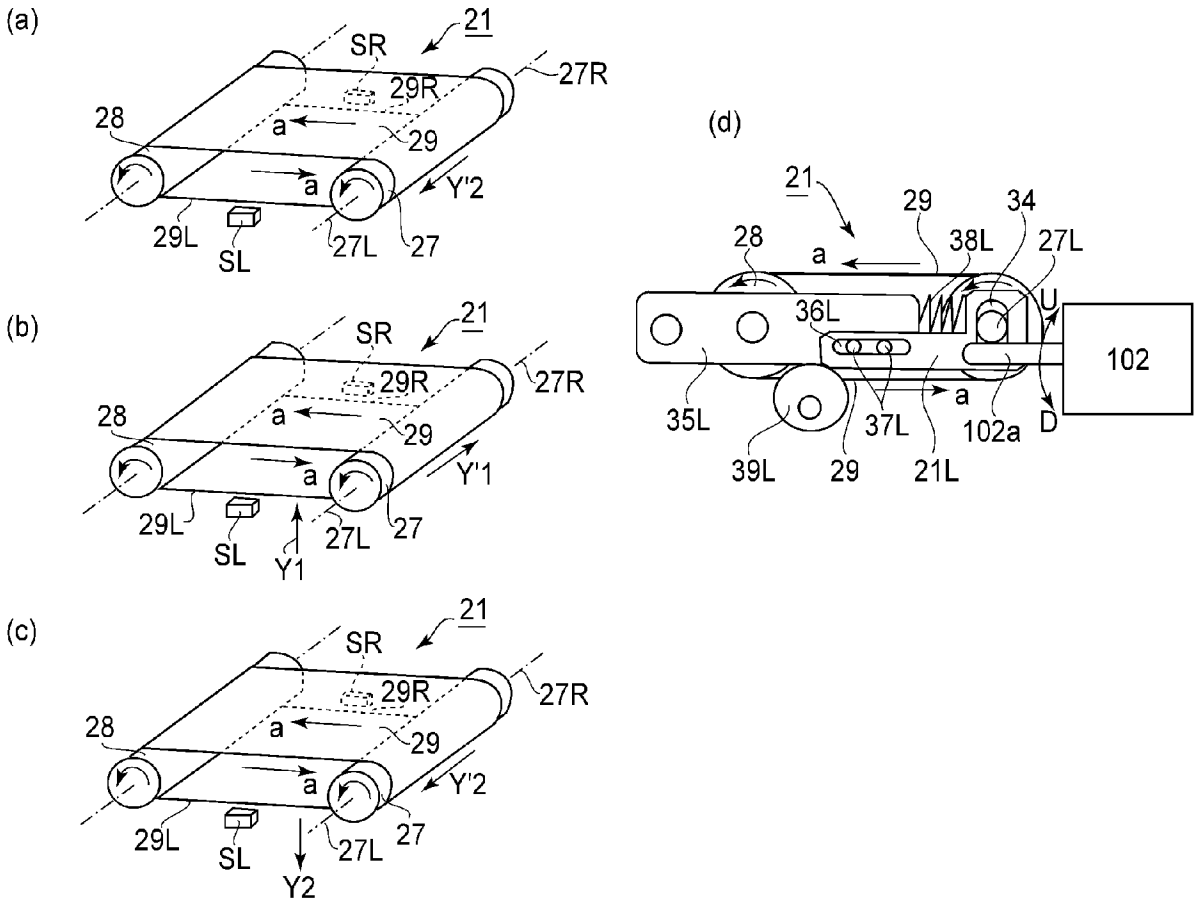
FIGS. 3(*a*), 3(*b*), and 3(*c*) are schematic perspective views of the fixing apparatus in the first embodiment, and illustrate the oscillatory manner in which the pressure belt of the image pressing unit is moved in the widthwise direction of the pressure belt.

Next, referring to FIGS. 3(*a*)-3(*c*), the method for controlling the positional (lateral) deviation of the pressure belt 29 of the image pressing unit 21 will be more concretely described. Incidentally, for convenience's sake, FIGS. 3(*a*)-3(*c*) are drawn so that the pressure belt 29 appears wider in FIGS. 3(*a*)-3(*c*) than in FIG. 1(*a*). Referring to FIG. 3(*a*), if the pressure belt 29 shifts leftward as indicated by the arrow mark Y'2 by more than a tolerable amount (preset amount) while the pressure belt 29 is rotated in the counterclockwise direction indicated by an arrow mark a, the left edge 29L of the pressure belt 29 is detected by a leftward belt shift sensor SL (belt shift sensing means). Then, the belt edge detection signal from the sensor SL is inputted into the control circuit 100 through the A/D converter 101 (FIG. 1(*a*)). Then, in response to this signal, the control circuit 100 causes a belt shift control portion 102, shown in FIG. 3(*d*), to operate in a preset manner. That is, it causes the belt shift control arm 102*a* of the belt shift control portion 102 in the clockwise direction U (FIG. 3(*d*)) to move by a preset angle, whereby the pressure-belt tensioning roller 27 is tilted so that the left-hand end 27L of its shaft moves upward, that is, in the direction indicated by the arrow mark Y1. Consequently, the pressure belt 29 is shifted backward, that is, in the rightward indicated by the arrow mark Y'1. On the other hand, if the pressure belt 29 shifts rightward as indicated by the arrow mark Y'1 by more than a tolerable amount (preset amount) while the pressure belt 29 is rotated, the right-hand edge 29R of the pressure belt 29 is detected by a right-hand belt edge sensor SR (belt shift sensing means). Then, the belt edge detection signal from the sensor SR is inputted into the control circuit 100 through the A/D converter 105. Then, in response to this signal, the control circuit 100 causes the belt shift control portion 102, shown in FIG. 3(*d*), to operate in a preset manner. That is, it causes the belt shift control arm 102*a* to move in the counterclockwise direction D by a preset angle, whereby the pressure-belt tensioning roller 27 is tilted so that the left-hand end 27L of its shaft moves downward, that is, in the direction indicated by the arrow mark Y2, as shown in FIG. 3(*c*). Consequently, the pressure belt 29 is shifted backward, that is, in the leftward direction indicated by the arrow mark Y'2. As described above, the right-hand end 27R of the shaft of the pressure-belt tensioning roller 27 is supported by the right-hand metallic plate 21R of the image pressing unit 21 so that the pressure-belt tensioning roller 27 is rotatable, and also, that the pressure-belt tensioning roller 27 can be tilted. The left-hand end 27L of the shaft of the pressure-belt tensioning roller 27 is supported by the left metallic plate 21L so that the pressure-belt tensioning roller 27 is rotatable, and also, that as the pressure-belt tensioning roller 27 is tilted, the left-hand end 27L of its shaft is vertically moveable within the vertical long hole 34 with which the left metallic plate 21L is provided. Therefore, the pressure-belt tensioning roller 27 can be tilted in such a manner that the left-hand end 27L of its shaft vertically moves as if the right-hand end 27R of its shaft is functioning as the fulcrum of the pressure-belt tensioning roller 27.

As described above, while the pressure belt 29 rotates, the control circuit 100 controls the belt deviation control portion 102 in the preset manner in response to the belt deviation detection signal inputted from the left-hand belt edge sensor SL or right-hand belt edge sensor SR. That is, the control circuit 100 can keep the lateral deviation of the pressure belt 29 roughly in the target range by controlling the leftward and rightward deviation of the pressure belt 29 by repeatedly tilting the pressure-belt tensioning roller 27 in such a manner that the left-hand end 27L of its shaft is vertically moved. In this embodiment, it took roughly 45 seconds for the pressure belt 29 to deviate leftward and return (rightward) to the starting point, and the distance (deviation control target range) of this reciprocal (oscillatory) movement was roughly 10 mm. Next, referring to FIG. 3(*d*), designated with reference characters 35L is the left metallic plate of the image pressing unit 21. The pressure-belt driving roller 28 is rotatably supported between this left metallic plate 35L and the right metallic plate (unshown). The slidably movable left metallic plate 21L is held to the left metallic plate L by a pair of guide pins 37L, which fit in a long hole 36L of the left metallic plate 21L in such a manner that the left metallic plate 21L is allowed to slide upstream or downstream relative to the left metallic plate 35L. Further, the slidably movable left metallic plate 21L is kept pressed downstream by a tension spring 38L which is between the left metallic plate 35L and slidably movable left metallic plate 21L, in such a manner that it can be slid upstream or downstream. Similarly, the slidably movable right metallic plate 21R (FIG. 3(*d*)) is held to the right metallic plate 35R by a pair of guide pins, which fit in a long hole of the right metallic plate 21R in such a manner that the slidably movable right metallic plate 21R is allowed to slide upstream or downstream relative to the right metallic plate 35. Further, the slidably movable right metallic plate 21R is kept pressed downstream by a tension spring which is between the right metallic plate and slidably movable right metallic plate, in such a manner that it can be slid upstream or downstream. Thus, the pressure-belt tensioning roller 27 is kept pressured in the direction to tension the pressure belt 29 while being allowed to move upstream or downstream. Therefore, the pressure belt 29 remains tensioned between the pressure-belt driving roller 28 and pressure-belt tensioning roller 27. Designated by reference characters 39L is a left cam of the image pressing unit moving mechanism 101 (FIG. 1(*a*)) for vertically moving the image pressing unit 21 relative to the image heating unit 20. The above-described belt deviation detecting means SL and SR, control circuit 100, and belt deviation control portion 102 make up the belt-deviation controlling means for controlling the positional (lateral) deviation of the pressure belt 29, that is, such a belt-deviation controlling means that controls the positional (lateral) deviation of the pressure belt 29 by changing in attitude (angle) the pressure-belt tensioning roller 27, which is the second belt suspending member, in response to the amount of the positional (lateral) deviation of the pressure belt 29 detected by the belt deviation detecting means SL and SR. The belt-deviation controlling means may be structured so that the positional (lateral) deviation of the pressure belt 29 is controlled by changing in attitude (angle) the pressure-belt driving roller 28 which is the first belt suspending means.

Up to this point, how the positional deviation of the pressure belt 29 is controlled was described. In this embodiment, however, at least one of the fixation belt 25 and the pressure belt 29 is controlled in terms of positional deviation. FIG. 7(*b*) shows an example of a fixation-belt, deviation-preventing means, which does not actively control the positional deviation of the fixation belt 25. In the case where the fixation belt 25 is not actively controlled in positional deviation, the lengthwise end portions of the fixation-belt driving roller 24 are fitted with a pair of belt bumpers 51 and 52, one for one, whose distance is roughly the same as the width of the fixation belt 25, so that the fixation belt 25 remains virtually in contact with pair of belt bumpers 51 and 52. Incidentally, the belt bumpers 51 and 52 may be fitted around the fixation-belt tensioning roller 23 instead of the fixation-belt driving roller 24, or both the fixation-belt tensioning roller 23 and the fixation-belt driving roller 24 may be fitted with the belt bumpers 51 and 52. As the material for the belt bumpers 51 and 52, PPS (polyphenyl sulfide) and LCP (liquid crystal polymer), which are heat resistant resins, may be used.

(7) First and Second Temperature-Detecting Members

Figure 4:
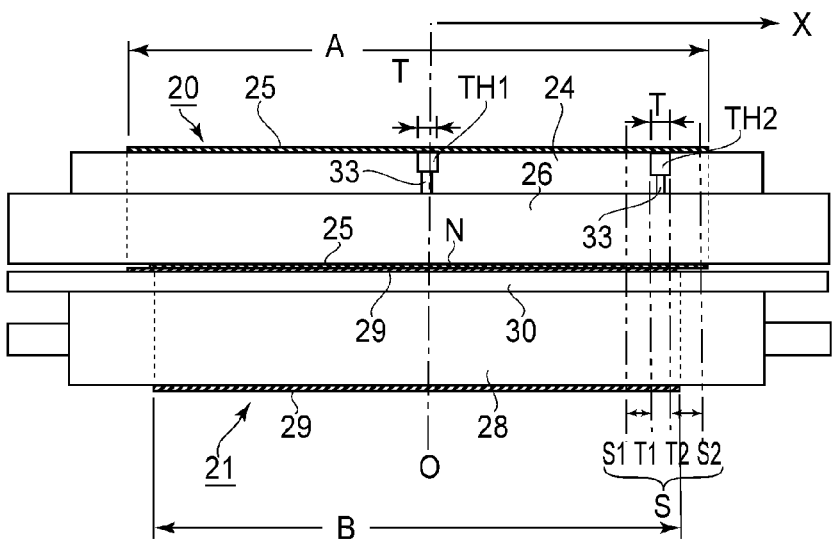
FIG. 4(*a*) is a schematic sectional view of the combination of the image heating unit and the image pressing unit, at the plane which is parallel to the widthwise direction of the fixation belt and coincides with both the axial line of the fixation-belt driving roller and the axial line of the pressure belt driving roller.
Figure 4:
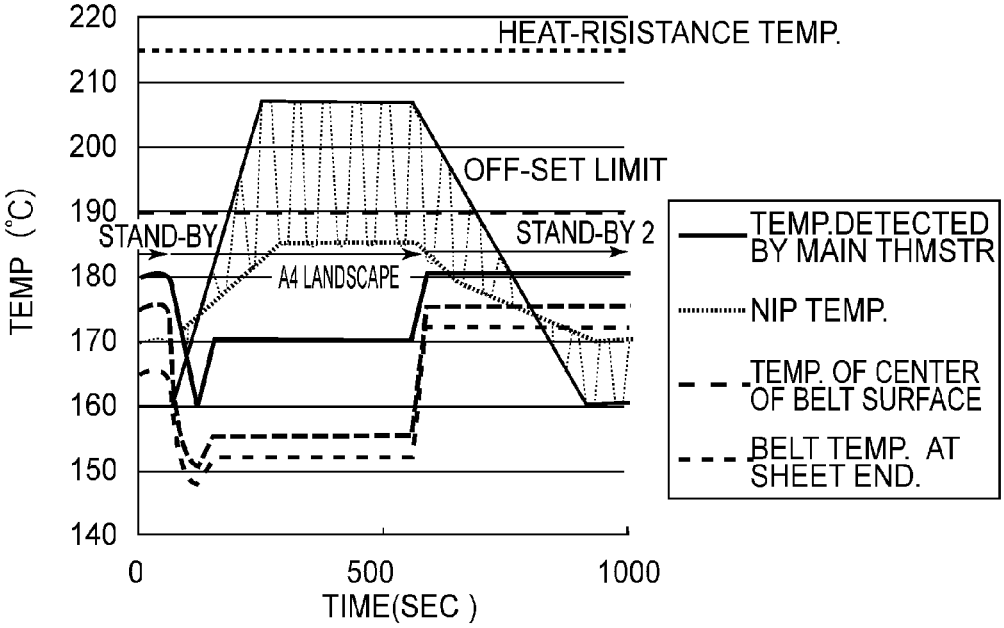

As described above, the image heating unit 20 is provided with the primary thermistor TH1 (first temperature-detecting means), which is kept pressed upon the fixation pad 26 of the image heating unit 20 with the presence of the elastic supporting member 33. Thus, the temperature-detecting surface of the primary thermistor TH1 is kept in contact with the inward surface of the fixation belt 25 by the elasticity of the elastic supporting member 33. The image heating unit 20 is provided with also the secondary thermistor TH2 (secondary temperature-detecting means) in addition to the primary thermistor TH2. The secondary thermistor TH2 also is kept pressed upon the fixation pad 26 with the presence of the elastic supporting member 33. Thus the temperature-detecting surface of the secondary thermistor TH2 is kept in contact with the inward surface of the fixation belt 25 by the elasticity of the elastic supporting member 33. Next, referring to FIGS. 4 and 5, the positioning and functions of the primary and secondary thermistors TH1 and TH2, respectively, will be described. FIG. 4(*a*) is a schematic vertical sectional view of the image heating unit 20 and the image pressing unit 21 of the fixing apparatus F. The primary and secondary thermistors TH1 and TH2, respectively, are roughly 5 mm in width T in terms of the lengthwise direction. They are immovable and are in their predetermined positions, one for one; they do not move in the lengthwise direction or the like. In this embodiment, the recording sheet S is conveyed in such a manner that the center of the recording sheet S coincides with the center of the recording sheet passage of the fixing apparatus F. Designated by a reference character O is the central reference line (hypothetical line). Designated by reference characters A and B are the measurements (widths) of the fixation belt 25 and pressure belt 29, respectively, in terms of the lengthwise direction. In this embodiment, A is greater than B (A>B). The induction heating coil unit 22 heats roughly the entirety of the fixation belt 25 in terms of the length wise direction thereof. The primary thermistor TH1 is the temperature-detecting means for detecting the temperature of the portion of the fixation belt 25, which corresponds in position to the recording-sheet path, in order to keep the temperature of this portion of the fixation belt 25 at a preset level (image heating level). The primary thermistor TH1 is positioned so that it will be in the path of the recording sheet S regardless of recording-sheet size, that is, whether the recording medium to be used for image formation is the largest recording sheet S conveyable through the apparatus, smallest recording sheet S conveyance through the apparatus, or the recording sheet S of the in-between size. Assuming that a sheet of recording media is conveyed through the fixing apparatus F so that its long edges become perpendicular to the recording-medium conveyance direction, the largest recording sheet S usable with the image forming apparatus (fixing apparatus) in this embodiment is of size A4. The measurement B of the pressure belt 29 in terms of the lengthwise direction is greater than the long edges of the largest recording sheet usable with the apparatus. Further, in this embodiment, in order to detect the temperature of the portion of the fixation belt 25, which corresponds in position to the above-mentioned referential line O, that is, the center line of the recording medium passage of the fixing apparatus F in terms of the lengthwise direction, the primary thermistor TH1 is positioned so that it contacts the center portion of the inward surface of the fixation belt 25 in terms of the lengthwise direction.

The secondary thermistor TH2 is disposed so that it is in contact with one of the fringe portions (fringe portions in terms of lengthwise direction) of the inward surface of the fixation belt 25. More specifically, it is disposed so that it can detect the temperature of the portion of the fixation belt 25, which will be on the outward side of the recording-sheet path in terms of the lengthwise direction, regardless of the oscillatory lateral movement of the pressure roller 29 in the lengthwise direction, and also, so that as the pressure belt 29 is moved in an oscillatory manner in the lengthwise direction to control its lateral deviation, the secondary thermistor TH2 can detect both the temperature of the "nip-forming portion" of the fixation belt 25, and the temperature of one of the "fringe portions" of the fixation belt 25, that is, the portions of the fixation belt 25, which are positioned at the fringe of the "nip-forming portion". Hereafter, the temperature of the nip-forming portion of the fixation belt 25 may be referred to simply as the "nip-portion temperature" of the fixation belt 25, whereas the temperature of the above-described "fringe portions" of the fixation belt 25 may be referred to simply as "fringe-portion temperature" of the fixation belt 25. That is, the "nip-portion temperature" means the temperature of the portion of the fixation belt 25 which is in contact with the pressure belt 29, whereas the "fringe-portion temperature" means the temperature of the portion of the fixation roller 25, which is not in contact with the pressure roller 29. To describe more precisely the positioning of the secondary thermistor TH2, assume that the position of the primary thermistor TH1 in FIG. 4(*a*) is the origin of a graph, and the lengthwise direction of the fixation belt 29 (a direction parallel to the rotational axis of fixation roller) is the axis X of the graph (a direction toward the secondary thermistor TH2 from the primary thermistor TH1 is positive direction). Referring to FIG. 4(*a*), a reference character S stands for the range of the oscillatory movement of the pressure-belt deviation, and reference characters S1 and S2 correspond to the minimum and maximum amounts, respectively, of the pressure belt oscillation. Further, a reference character T stands for the width of the secondary thermistor TH2, and reference characters T1 and T2 stand for the closest point and farthest point, respectively, of the secondary thermistor TH2 from the origin. There is the following relationship: $S1<T1<T2<S2$. That is, when the pressure belt 29 is being laterally moved in an oscillatory manner to control its lateral deviation, the portion of the fixation belt 25, with which the secondary thermistor TH2 is in contact, is not always in contact with the pressure belt 29. Further, the position of the secondary thermistor TH2 is such that when the largest recording sheet, that is, a recording sheet S of size A4, is horizontally conveyed through the fixation nip, the distance from the edge of the recording sheet to the secondary thermistor TH2 is 5-10 mm. Thus, the secondary thermistor TH2 can detect the temperature of the inward surface of the portion of the fixation belt 25, in the adjacencies of the recording sheet edge.

The primary thermistor TH1 detects the temperature of the inward surface of the portion of the fixation belt 25, which corresponds in position to the recording-sheet path. Then, it inputs the result of the detection into the control circuit 100 through the A/D converter 105. Then, the control circuit 100 controls the electric power supply to the exciter coil 31 so that the information of the detected temperature inputted from the primary thermistor TH1 matches the temperature detection information regarding the preset fixation temperature so that the temperature of the above-described nip-forming portion of the fixation belt 25 is maintained at a preset level (proper level for fixation). In the case where the primary thermistor TH1 is used to detect an abnormal temperature increase of the fixation belt 25, the control circuit 100 performs the following control procedure. That is, if the primary thermistor TH1 detects that the temperature of the fixation belt 25 is no less than a preset level longer than a preset length of time, the control circuit 100 turns off the electric power supply from the AC power source 104 to the induction heating coil unit 22. In this embodiment, the fixing apparatus F is driven at process speed of 280 mm/sec, which amounts to 60 sheets of size A4 per minute, with the recording sheets conveyed in such an attitude that the long edges of the recording sheet are perpendicular to the recording-sheet conveyance direction. That a recording sheet is horizontally conveyed means that the recording sheet is conveyed in such an attitude that the long edges of the sheet are perpendicular to the recording sheet advancement (conveyance) direction. When recording sheets of size A4 are vertically and continuously conveyed, the processing speed of the fixing apparatus F is 45 sheets per minute. That a recording sheet is vertically conveyed means that the recording sheet is conveyed in such an attitude that the short edges of the sheet are perpendicular to the advancement direction of the recording sheet. Further, in a case where a substantial number of recording sheets of size A4 are vertically conveyed, the control circuit 100 reduces, as necessary, the number of recording sheets conveyed per minute (sheet count per unit length of time). This control procedure will be described later in detail. Here, when a recording sheet of size A4 is horizontally conveyed, it will be referred to as a large recording sheet, whereas when it is vertically conveyed, it will be referred to as a small recording sheet.

1) When Recording Sheets of Size A4 are Horizontally Conveyed

FIG. 4(*b*) is a graph which shows the temperatures detected by the primary thermistor TH1 and the secondary thermistor TH2 when recording sheets of size A4 were horizontally and continuously conveyed. FIG. 4(*b*) includes the temperature of the inward surface of the "nip-forming portion" of the fixation belt 25, the temperature of the inward surface of the "fringe portion" of the fixation belt, the temperature of the outward surface of the center of the fixation belt 25, and the temperature of the outward surface of the edge portion of the fixation belt 25, which were experimentally measured at the points shown in FIG. 5(*a*). In this embodiment, as the positional deviation of the pressure belt 29 in the lengthwise direction is controlled by the control circuit 100, the pressure belt 29 is moved in an oscillatory manner in the lengthwise direction. Thus, the portion of the inward surface of the fixation belt 25, with which the secondary thermistor TH2 is in contact, alternately becomes a part of the fixation nip-forming portion, and stops being a part of the fixation nip-forming portion. Thus, the secondary thermistor TH2 can alternately detect the temperature of the "nip-forming portion" of the fixation belt 25 and the temperature of the "fringe portion" of the fixation belt 25. Consequently, the temperature of the inward surface of the fixation belt 25 detected by the secondary thermistor TH2 fluctuates as shown in FIG. 4(*b*). The temperature of the inward surface of the fixation belt 25 is always 5-20° C. higher than the corresponding point on the outward surface of the fixation belt 25 in terms of the lengthwise direction. First, the temperature fluctuations which occur in a standby period 1 will be described. The standby period 1 is the period in which the image forming apparatus (fixing apparatus F) is kept on standby while the image forming apparatus is waiting for a print start signal. During the standby period 1, the image pressing unit 21 is not kept pressed upon the image heating unit 20, and the temperature distribution of the fixation belt 25 is such that the farther from the center of the fixation belt 25 in terms of the lengthwise direction, the lower the temperature, because of the effect of the heat radiation from the edge portion of the fixation belt 25, and the like factors. Thus, during the standby period 1, that is, the standby period prior to the starting of an image forming operation, the relationship in terms of the temperature among the portions of the fixation belt 25 which corresponds in position to the primary thermistor TH1, the "nip-forming portion", and the "fringe portion" is: portion corresponding to the secondary thermistor TH2>"nip-forming portion">"fringe portion". As for the temperature of the outward surface of the fixation belt 25, the temperature of a given point on the outward surface of the fixation belt 25 in terms of the lengthwise direction is always 5-10° C. lower than the corresponding point on the inward surface of the fixation belt 25.

Next, the temperature fluctuation of the fixation belt 25 which occurs while recording sheets of size A4 are horizontally and continuously conveyed will be described. When recording sheets are conveyed, the image pressing unit 21 is kept pressed upon the image heating unit 20. As the horizontal conveyance of recording sheets of size A4 is started, the temperature of the "center portion" of the fixation belt 25 and the temperature of the "portion of the fixation belt 25" which corresponds to the edge portions of the recording sheet, temporarily fall. However, the temperature of the fixation belt 25 is controlled so that the "temperature detected by the primary thermistor TH1" converges to 170° C., which is the target level for proper fixation. That is, the temperature of the "center portion" of the fixation belt 25, and the temperature of the "portion of the fixation belt 25" which corresponds in position to the outward edge of the recording sheet are also are affected (remain roughly stable) by the control, becoming stable. On the other hand, the "fringe-portion temperature" slightly increases immediately after the starting of the recording-sheet conveyance. This occurs because the "fringe-portion temperature" is detected by the thermistor TH2, which is outside the recording-sheet path, in terms of the lengthwise direction, when a recording sheet of size A4 is horizontally conveyed. However, as the temperature of the fixation belt 25 begins to be controlled in response to the temperature of the fixation belt 25 detected by the primary thermistor TH1, it eventually settles to roughly 180° C. Although the "fringe portion" is outside the recording-sheet path, the pressure belt 29 is in contact with the fixation belt 25. Thus, the heat of the fixation belt 25 is robbed by the pressure belt 29, and the temperature increase of "fringe portion" remains in the adjacencies of the abovementioned level. The "edge portion temperature" of the fixation belt 25 becomes highest, because the edge portions of the fixation belt 25 are outside the recording-sheet path, and are not in contact with the pressure belt 29. While copies are actually printed, the temperature of the fixation belt 25 is controlled so that the temperatures of various components of the fixing apparatus F will not exceed the highest temperatures (215° C. in this embodiment) they can withstand. In reality, however, it is common practice to design a fixing apparatus so that the temperature of the fixing member does not exceed the highest temperature it can withstand when a large recording sheet, for example, a recording sheet of size A4, is horizontally conveyed. Thus, when large recording sheets, for example, recording sheets of size A, are used with image forming apparatuses equipped with a fixing apparatus equipped as described above, the fixing apparatus does not need to be specifically controlled in temperature. Incidentally, if the surface temperature of the fixation belt 25 is higher than the temperature level (190° C. in this embodiment) above which "hot offset" will occur, the next printing job cannot be started. However, most image forming apparatuses (fixing apparatuses) are designed so that when recording sheets of size A4 are horizontally conveyed, the surface temperature of the fixation belt does not exceed the level above which "hot offset" will occur, as described above. Therefore, in a printing operation in which recording sheets of size A4 are horizontally and continuously conveyed, it does not occur that after the completion of the printing job, an operator has to wait a certain length of time before the operator can start the next printing job. Here, the "hot offset" refers to a phenomenon in which, if the temperature of the fixation belt 25 is no lower than a certain level, the toner on a recording sheet S soils the fixation belt 25 by transferring onto the fixation belt 25. During the standby period 2, the fixation belt 25 becomes stabilized in temperature Here, the standby period 2 is the period between the completion of a printing job in which a single copy is made, or multiple copes are continuously made, and when the print start signal for the next printing job is inputted. During the standby period 2, the image pressing unit 21 is not pressed upon the image heating unit 20; the former is kept separated from the latter.

Figure 5:
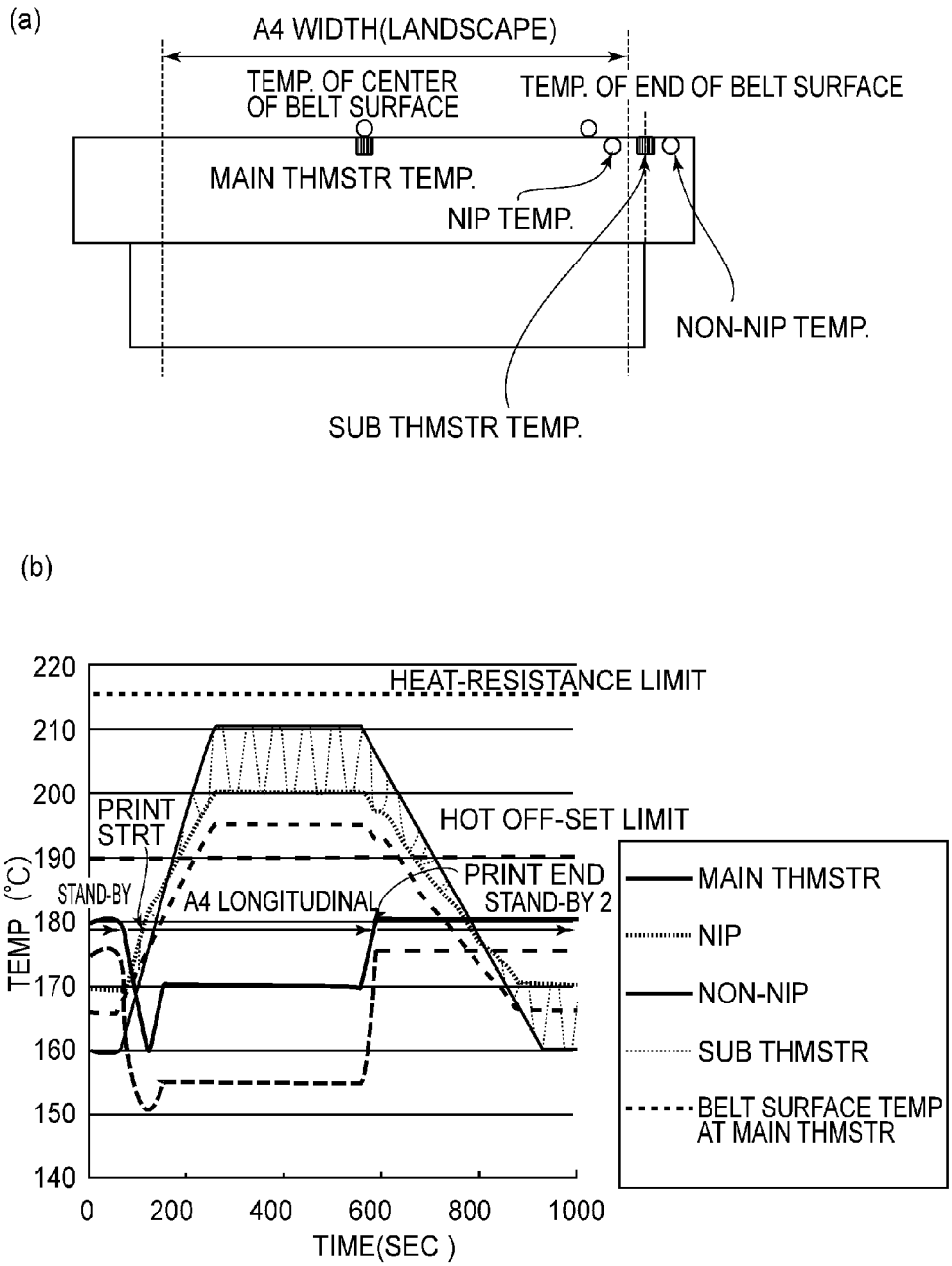
FIG. 5(*a*) is a schematic drawing which shows the points at which the temperature of the fixation belt is measured.

2) When Small Recording Sheets are Conveyed (Recording Sheet of Size A4 is Vertically Conveyed FIG. 5(*b*) is a graph which shows the temperature fluctuation detected by the primary thermistor TH1 and the secondary thermistor TH2 when recording sheets of size A4 were vertically conveyed. First, the temperature fluctuations which occur to various components of the fixing apparatus F during the standby period 1 will be described. During the standby period 1, the image pressing unit 21 is not kept pressed upon the image heating unit 20, and the temperature distribution of the fixation belt 25 is such that the farther from the center of the fixation belt 25 in terms of the lengthwise direction, the lower the temperature, because of the effect of the heat radiation from the edge portion of the fixation belt 25, and the like factors. Thus, during the standby period 1, that is, the standby period prior to the starting of an image forming operation, the relationship in terms of temperature among the portions of fixation belt 25 which corresponds in position to the primary thermistor TH1, the "nip-forming portion", and the "fringe portion" is: portion corresponding to primary thermistor TH1>"nip-forming portion">"fringe portion". As for the temperature of the outward surface of the fixation belt 25, the temperature of a given point on the outward surface of the fixation belt 25 in terms of the lengthwise direction is always lower by 5-10° C. than the corresponding point on the inward surface of the fixation belt 25. Next, the temperature fluctuations of the portion of the fixation belt 25, which corresponds in position to the recording-sheet path, when the recording sheet of size A4 is vertically conveyed will be described. As the vertical conveyance of a recording sheet of size A4 is started, the portion of the fixation belt 25, which corresponds in position to the recording-sheet path, and the temperature of which is detected by the primary thermistor TH1, falls in temperature. Eventually, its temperature settles to a preset level (fixation level, which is 170° C. in FIG. 5(*b*)) because of the temperature control. On the other hand, the edge portions of the fixation belt 25 are not robbed of heat by a recording sheet and/or the pressure belt 29. Therefore, these portions gradually increase in temperature. Thus, as the conveyance of recording sheets continues more than a certain length of time, the temperature of these portions reach the highest level (210° C. in FIG. 5(*b*)). Because the highest temperature level which the fixing member can withstand is 215° C., the image forming apparatus is reduced in productivity (in the printing operation in which recording sheets of size A4 are vertically conveyed). Reducing the productivity of the image forming apparatus (while small recording sheets are used as recording medium) means reducing the number of recording sheets conveyed through the fixing apparatus F per unit length of time. More specifically, it means such a control that increases the intervals with which the recording sheets S are conveyed through the fixing apparatus F and/or reduces the speed with which recording sheets S are conveyed through the fixing apparatus F. In this embodiment, initially, recording sheets of size A4 are vertically conveyed at a rate of 45 sheets per minute. Then, as the detected temperature of the edge portions of the fixation belt 25 exceeds 210° C., the rate is reduced in steps to 40 sheets/m, 35 sheets/m, and then, to 30 sheets/m. By employing this control method, the temperature of the edge portions of the fixation belt 25 are kept at roughly 210° C. Concerning the reduction in productivity, the temperature level detected by the secondary thermistor TH2 is inputted into the control circuit 100. Then, the image forming apparatus is reduced in productivity by sending control signals to various portions of the apparatus in response to the value of the inputted temperature level.

During this period, the nip-forming portion of the fixation belt 25 is not robbed of heat by recording sheets. Therefore, it is expected to gradually increase in temperature. However, it is robbed of heat by the pressure belt 29. Therefore, if recording sheets are continuously conveyed longer than a certain length of time, its temperature becomes lower than that of the "fringe portion" of the fixation belt 25. That is, the portion of the fixation belt 25, which is the highest in the detected temperature during this period is the "edge portion" of the fixation belt 25, and the image forming apparatus is controlled in productivity so that the temperature of the "edge portion" of the fixation belt 25 remains constant.

Next, the control executed during the standby period 2 will be described. As soon as recording-sheet conveyance ends, the fixing apparatus F begins to be controlled so that the temperature detected by the primary thermistor TH1 remains stable at a target level of 180° C. The "edge portion" of the fixation belt 25 gradually decreases in temperature because of the effects of the heat radiation from the edges, etc., of the fixation belt 25. Eventually, the temperature of the "edge portion" of the fixation belt 25 settles to 160° C., at which it was before the image forming operation was started. As for the temperature of the "nip-forming portion" of the fixation belt 25, it similarly falls. However, it is not affected by the heat radiation as much as the "edge portion". Therefore, the temperature of the "nip-forming portion" of the fixation belt 25 does not fall as much as the "edge portions"; it settles to 170° C.

In a case where it becomes necessary to start to horizontally convey recording sheets of size A4 in the middle of the standby period 2, an operator has to wait until the "nip-forming portion" of the fixation belt 25 falls below 190°, that is, the temperature level above which "hot offset" occurs, for the purpose of preventing "hot offset". For accuracy, it is preferred that whether or not the image forming apparatus is ready for accepting a print start signal is determined based on the temperature of the "fringe portion" of fixation belt 25 relative to the path of a recording sheet of size A4. In this embodiment, whether or not the image forming apparatus is ready for accepting a print-start signal is determined based on the "nip-forming-portion temperature" which is closer to the "fringe-portion temperature" of the fixation belt 25 relative to the path of a recording sheet of size A4. The reason why it is preferred that whether or not the image forming apparatus is ready for accepting a print-start signal is determined based on the temperature of the "nip-forming portion" of the fixation belt 25 is that the temperature of the "nip-forming portion" is closer to the temperature of the portion of the fixation belt 25 which corresponds in position to the path of a horizontally conveyed recording sheet of size A4, and therefore, whether or not the apparatus is ready for accepting a print signal can be more accurately determined based on the temperature of the "nip-forming portion" of the fixation belt 25 than based on the temperature of the "edge portions" of the fixation belt 25.

In the above, for the sake of convenience, the control executed during the standby period 2 was described in relation to the temperature of the "nip-forming portion" of the fixation belt 25 and the temperature of the "edge portions" of the fixation belt 25. In this embodiment, however, the secondary thermistor TH2 is positioned so that it can detect both the "nip-forming-portion temperature" and "edge-portion temperature" in synchronism with the oscillatory lateral movement of the pressure belt 29, which is caused for controlling the positional (lateral) deviation of the pressure belt 29. Therefore, it is possible to execute the following two procedures using only the secondary thermistor TH2. The procedure 1 is that if the temperature of the fixing member approaches the highest level which the fixing member can withstand, while small recording sheets are continuously conveyed, the image forming apparatus is to be reduced in productivity. The second control procedure is to be executed after the completion of the conveyance of small recording sheets. It is for determining whether or not an operation in which large recording sheets are used as the recording medium may be started.

The summary of the structure of the fixing apparatus (image heating apparatus) in this embodiment is as follows:

The fixing apparatus has the fixation belt 25, which is an image heating member in the form of an endless belt. The fixation belt 25 is suspended by the pair of belt suspending members 27 and 28, being stretched between the two members. It is circularly driven. The fixing apparatus has also the pressure belt 29 which also is in the form of an endless belt. It forms the fixation nip N between itself and fixation belt 25 by being pressed upon the fixation belt 25. The fixing apparatus has also a belt-deviation controlling means which controls the positional deviation of the pressure belt 29 in the direction parallel to the axial lines of the belt suspending members, by changing in attitude at least one of the belt suspending members 27 and 28 relative to the other by tilting at least one of the members 27 and 28. The fixing apparatus is an apparatus which heats the recording sheet S on which the toner image t is present, by conveying it through its fixation nip N, while keeping the recording sheet S pinched by the fixation belt 25 and pressure belt 29. The fixing apparatus has the first and second temperature-detecting means TH1 and TH2, respectively, for detecting the temperatures of the recording-sheet-path portion of the fixation belt 25, the temperature of the "fringe portions" of the fixation belt 25 relative to one of the edges of the recording-sheet path, and the temperature of one of the edge portions of the fixation belt 25, respectively, in order to keep the recording-sheet-path portion of the fixation belt 25 at the preset level for the image heating portion of the fixation belt 25. The second temperature-detecting means TH2 is in contact with the portion of the fixation belt 25, which becomes either the "fixation nip-forming portion" or the "fringe portion" depending on the fixation belt position in terms of the lengthwise direction. Further, it is in a position in which it can detect the temperatures of both the "nip-forming-portion temperature" and the "fringe-portion temperature". The "nip-portion temperature" is the temperature of the portion of the fixation belt 25 across which the pressure belt 29 is pressed. The "fringe-portion temperature" is the temperature of the portion of the fixation belt 25, across which the pressure belt 29 is not pressed. The information obtained by detecting the "nip-portion temperature" and the information obtained by detecting the "fringe-portion temperature" is inputted into the control circuit 100 to be used as the information (control signals) for controlling the apparatus.

In terms of width, the fixing apparatus can accommodate more than two kinds of recording sheets. Assuming that a small recording sheet is a recording sheet which is not greatest in width, the information obtained by detecting the "nip-forming-portion temperature", and the information obtained by detecting the "fringe-portion temperature", are used as the information (control signals) for controlling the fixing apparatus in temperature when small recording sheets are conveyed. The information obtained by detecting the "nip-forming-portion temperature" is used as the control signal for controlling the image forming apparatus 1 in the number of small recording sheets to be allowed to conveyed through the apparatus per unit length of time, whereas the information obtained by detecting the "fringe-portion temperature" is used as the control signal for stopping the image forming apparatus 1. Further, the information obtained by detecting the "nip-forming-portion temperature" is used as the control signal for determining the timing with which the apparatus is allowed to be used for a printing operation in which large recording sheets are continuously conveyed, after the completion of the conveyance of small recording sheets, whereas the information obtained by detecting the "fringe-portion temperature" is used as the control signal for controlling the apparatus in terms of the number of small recording sheets allowed to be conveyed through the apparatus per unit length of time. That is, not only is the primary object of the present invention to increase the productivity of an image heating apparatus of the belt type, as much as possible, in an image forming operation in which small recording sheets are used as recording media, but also, to reduce as much as possible, the length of time an operator has to wait after the interruption of an image forming operation in which small recording sheets are used as recording media in the image forming apparatus. In order to achieve the abovementioned objects, the process of controlling the positional (lateral) deviation of the pressure belt 29 is utilized to detect the temperatures of the following two portions 1 and 2 of the image heating member 25 with the use of the temperature-detecting means TH2. The portion 1 is the portion which is in contact with the pressure belt 29 (nip portion), and the portion 2 is the portion which is not in contact with the pressure belt 29 (fringe portion). The temperature of the highest temperature portion of the image heating member 25 is detected at the portion 1 to control the image forming apparatus in productivity when small recording sheets are used as recording media, and the temperature of the fringe portions of the surface of the image heating member detected at the portion 2 is used to reduce the length of time an operator has to wait before the restarting of the image forming operation after the interruption of the operation in which small recording sheets are continuously conveyed in the image forming apparatus.

Embodiment 2

Figure 6:
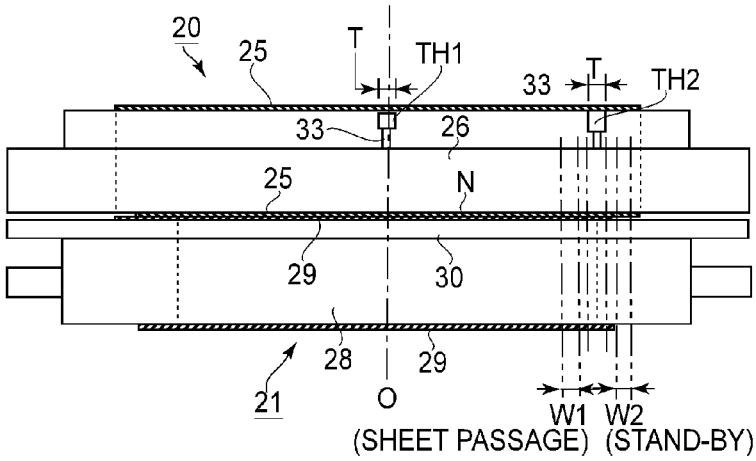
FIG. 6(*a*) is a schematic drawing of the fixing apparatus in the second embodiment of the present invention, and shows the positioning of the secondary thermistor and the range in which one of the edges of the pressure belt is moved to control the positional deviation of the pressure belt.
Figure 6:
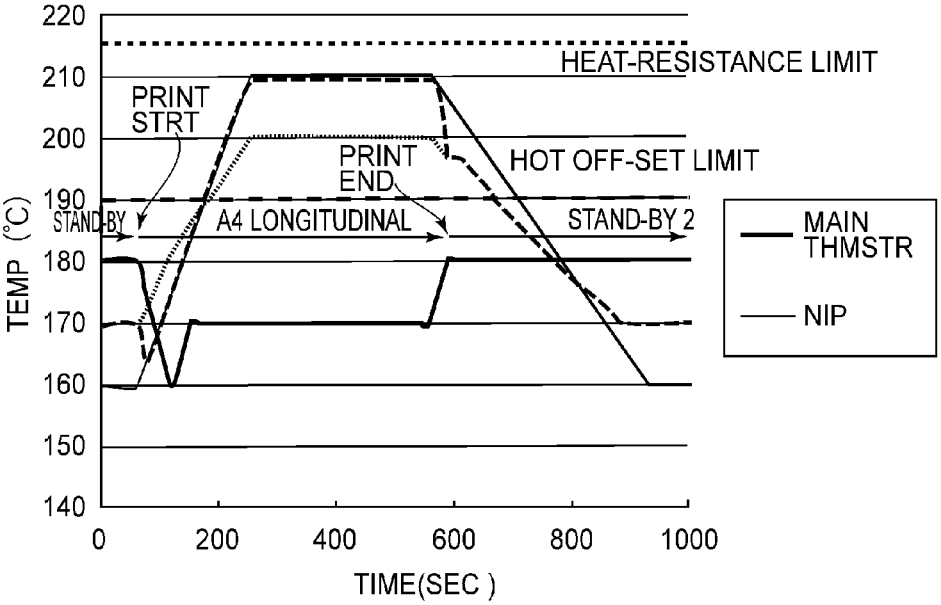

The image forming portion in this embodiment is the same as that in the first embodiment. Referring to FIG. 6(*a*), in this embodiment, the range in which the pressure belt 29 is moved in an oscillatory manner by the belt deviation control while recording sheets are conveyed is different from that while the image forming apparatus (fixing apparatus) is kept on standby. That is, while recording sheets are conveyed, the pressure belt 29 is controlled in its oscillatory movement for positional deviation control so that one of its edges moves in an oscillatory manner in a range W1. While the image forming apparatus is kept on standby, however, the pressure belt 29 is controlled in its oscillatory movement for positional deviation control so that the same edge of the pressure belt 29 moves in an oscillatory manner in a range W2. The method for controlling the oscillatory movement of the pressure belt 29 so that one of its edges move in an oscillatory manner in the ranges W1 and W2 are as follows. First, referring to FIG. 7(*c*), the fixing apparatus in this embodiment is provided with a belt-position detection member 53, and four photosensors for detecting the position of the belt-position detection member 53. The belt-position detection member 53 is in contact with one of the edge of the pressure belt 29. Each photosensor is made of two portions, that is, a light emitting portion and a light receiving (sensing) portion. That is, there are four light emitting portions 54, 55, 56, and 57, and four corresponding light receiving portions 54' 55', 56', and 57', respectively. As the pressure belt 29 deviates into the area between the light emitting portion 54 and light receiving portion 54', the light from the light emitting portion 54 does not enter the light receiving portion 54', indicating that the pressure belt 29 has deviated as far as the area between the light emitting portion 54 and light receiving portion 54'. That is, the ranges W1 and W2 correspond to the area between the first and second belt edge position sensors 54 and 55, and the area between the third and fourth belt edge position sensors. With the employment of this structural arrangement, it is possible to control the oscillatory movement of the pressure belt 29 in such a manner that one of the edges of the pressure belt 29 remains in the range W1 or W2. While the image forming apparatus is kept on standby, the oscillatory pressure belt movement is controlled so that one of edges of the pressure belt 29 moves in an oscillatory manner in the range W2. That is, while recording sheets are conveyed, the oscillatory pressure belt movement for pressure belt deviation control is controlled so that the temperature of the fringe portion of the fixation belt 25, which is likely to be higher than the temperature of the nip-forming portion of the fixation belt 25, can be measured by the secondary thermistor TH2, that is, so that the nip is not formed far enough to invade into the secondary thermistor territory. On the other hand, while the image forming apparatus is kept on standby, the oscillatory pressure belt movement is controlled so that the temperature of the nip-forming portion of the fixation belt 25 (the portion of the fixation belt 25 that forms nip as the pressure belt 29 is pressed on fixation belt 25), which more accurately reflects the temperature of the fringe portion of the fixation belt 25 to the recording-sheet path. In other words, the oscillatory-pressure-belt movement is controlled so that the secondary thermistor TH2 remains in contact with the portion of the fixation belt 25, which remains as the nip-forming portion regardless the pressure belt oscillation.

FIG. 6(*b*) shows the actual temperature fluctuations detected by the thermistors TH1 and TH2 while small recording sheets were conveyed (recording sheets of size A4 were vertically conveyed). The secondary thermistor TH2 is enabled to detect the temperature of the fringe portion of the fixation belt 25, that is, the temperature level of the highest temperature portion of the fixing member, by controlling the oscillatory-pressure-belt movement for controlling the positional deviation of the pressure belt 29 in such a manner that one of the edges of the pressure belt 29 moves in an oscillatory manner in the range W1. During the standby period which occurs thereafter, the secondary thermistor TH2 is enabled to detect the nip-forming portion of the fixation belt 25, and therefore, the control circuit 100 is enabled to determine whether or not the image forming apparatus is ready for accepting large recording sheets. With the employment of this structural arrangement, it is possible to more accurately detect the temperature levels of various portions of the fixing apparatus F, but also, to more accurately manage time in terms of apparatus control. Further, this embodiment of the present invention is particularly effective to control a fixing apparatus characterized in that because its fixation belt (25) is small is thermal capacity, or for the like reason, it quickly rises in temperature while its pressure belt (29) is controlled in positional deviation.

The summary of the above-described structural features of the fixing apparatus (image heating apparatus) in this embodiment is as follows. The fixing apparatus can be switched in the ranges in which its pressure belt 29 is allowed to move in an oscillatory manner by the pressure-belt deviation control. That is, this embodiment makes it possible to select a range in which its pressure belt 29 is allowed to move in an oscillatory manner by the pressure-belt deviation control. More specifically, the range W2 can be selected so that the pressure belt 29 always remains in contact with the portion of the fixation belt 25, in terms of the lengthwise direction, with which the second temperature-detecting means TH2 is in contact. The range W1 can be selected so that the pressure belt 29 does not always remains in contact with the portion of the fixation belt 25, in terms of the lengthwise direction, with which the second temperature-detecting means TH2 is in contact. The switching of the pressure belt oscillation range is made based on the operational state of the image forming apparatus (whether apparatus is on standby or recording sheets are conveyed).

Embodiment 3

The image forming portion in this embodiment is the same as that in the first embodiment. In this embodiment, the control circuit 100 controls the image forming apparatus in productivity so that the temperature of the nip-forming portion of the fixation belt remains stable at a preset level during a print job in which small recording sheets are used as recording mediums. That is, as long as the image forming apparatus is controlled so that during a printing job in which small recording sheets are used as recording mediums, the "nip-portion temperature" always remains lower than the hot offset triggering level, it is unnecessary for an operator to wait until the "nip-portion temperature" falls below the not-offset triggering level, before starting a printing job in which large recording sheets are used as recording mediums. In this case, the "fringe-portion temperature" can be used as a control signal for interrupting the operation of the fixing apparatus as the "fringe-portion temperature" comes close to the highest temperature level which the fixing member can withstand. Also in this embodiment, both the "nip-forming-portion temperature" and "fringe-portion temperature" can be detected by the second thermistor by synchronizing the temperature-detection timing with the pressure-belt position in terms of the lengthwise direction.

[Miscellanies]

1) The fixing apparatuses (image heating apparatuses) in the preceding embodiments of the present invention may be structured so that a heat roller, which is externally or internally heated with the use of an appropriate heating means, such as an induction heating coil unit, a halogen lamp, and the like, can be used a heating member instead of the fixation belt 25.

2) The fixing apparatuses (image heating apparatuses) in the preceding embodiments of the present invention may be structured so that when a sheet of recording media is conveyed through the fixing apparatuses, its center align with the center of the recording medium passage of the fixing apparatus.

According to the present invention, it is possible to provide an image heating apparatus of the belt type, which is substantially smaller in the number of temperature-detecting members, higher in productivity when small recording sheets are used as recording media, and significantly shorter in the length of time a user has to wait before starting an image forming operation in which large recording sheets are used as recording mediums, after the completion of an image forming operation in which small recording sheets are used as recording media.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 121831/2009 filed May 20, 2009 which is hereby incorporated by reference.

What is claimed is:

1. An image heating apparatus, comprising:

image heating means for heating an image on a recording material with the heat;

a belt member configured to form a nip which nips and feeds the recording material by pressing said image heating means;

a belt position adjusting means for adjusting a position of said belt member in a widthwise direction;

a first temperature detecting member which is provided in a minimum sheet processing region for the recording material of a minimum size, and detects a temperature of said image heating means;

a first controller configured to control electric power supply to said image heating means on the basis of an output of said first temperature detecting member;

a second temperature detecting member, provided at an end of said image heating means, configured to detect a temperature of said image heating means, wherein said second temperature detecting member is capable of detecting a temperature of an area of said image heating means which is out of contact with said belt member when said belt member is in one position with respect to the widthwise direction, and is capable of detecting a temperature of an area of said image heating means which is contacting said belt member when said belt member is in another position with respect to the widthwise direction; and a second controller configured to control the image heating operation at the time of the continuous image formation on the basis of the temperature of the area of said image heating means which is out of contact with said belt member and to control the start of the image heating operation on the basis of the temperature of the area of said image heating means which is in contact with said belt member.

2. An apparatus according to claim 1, wherein said image heating means heats a toner image on the recording material in contact with the recording material, and a length of the image heating means measured in the widthwise direction is longer than a length of the belt member in the widthwise direction.

3. An apparatus according to claim 1, wherein said second temperature detecting member is disposed out of a maximum sheet processing region for the recording material of a maximum size with respect to the widthwise direction.

4. An apparatus according to claim 1, wherein at the time of the continuous image formation, when the temperature of the area of said image heating means which is out of contact with said belt member reaches a first predetermined temperature, the number of processed recording materials per unit time is reduced.

5. An apparatus according to claim 4, wherein the operation for forming the image on the recording material having a length not more than a predetermined length measured in said widthwise direction is executed when the temperature of the area of said image heating means which is out of contact with said belt member is below a second predetermined temperature.

6. An apparatus according to claim 1, wherein said image heating means includes an image heating belt member which heats the toner image on the recording material in contact with the recording material, and a second belt position adjusting means for adjusting the position, in the widthwise direction, of said image heating belt member, wherein said second belt position adjusting means adjusts the position of said image heating belt member with respect to the widthwise direction so that said image heating belt member is positioned within a range in which said second temperature detecting member is always in contact with said image heating belt member.

7. An image heating apparatus, comprising:

image heating means for heating an image on a recording material with the heat;

a belt member configured to form a nip which nips and feeds the recording material by pressing said image heating means;

a belt position adjusting means for adjusting a position of said belt member in a widthwise direction;

a first temperature detecting member which is provided in a minimum sheet processing region for recording material of a minimum size, and detects a temperature of said image heating means;

a first controller configured to control electric power supply to said image heating means on the basis of an output of said first temperature detecting member; and a second temperature detecting member, provided at an end of said image heating means, configured to detect a temperature of said image heating means, wherein said second temperature detecting member is disposed at a position in which said second temperature detecting member is capable of detecting a temperature of an area of said image heating means which is out of contact with said belt member when said belt member is in one position with respect to the widthwise direction, and is capable of detecting a temperature of an area of said image heating means which is contacting said belt member when said belt member is in another position with respect to the widthwise direction.

8. An apparatus according to claim 7, wherein said image heating means heats a toner image on the recording material in contact with the recording material, and a length of the image heating means measured in the widthwise direction is longer than a length of the belt member in the widthwise direction.

9. An apparatus according to claim 7, wherein said second temperature detecting member is disposed out of a maximum sheet processing region for the recording material of a maximum size with respect to the widthwise direction.

10. An apparatus according to claim 7, wherein at the time of the continuous image formation, when the temperature of the area of said image heating means which is out of contact with said belt member reaches a first predetermined temperature, the number of processed recording materials per unit time is reduced.

11. An apparatus according to claim 10, wherein the operation for forming the image on the recording material having a length not more than a predetermined length measured in said widthwise direction is executed when the temperature of the area of said image heating means which is out of contact with said belt member is below a second predetermined temperature.

12. An apparatus according to claim 7, wherein said image heating means includes an image heating belt member which heats the toner image on the recording material in contact with the recording material, and a second belt position adjusting means for adjusting the position, in the widthwise direction, of said image heating belt member, wherein said second belt position adjusting means adjusts the position of said image heating belt member with respect to the widthwise direction so that said image heating belt member is positioned within a range in which said second temperature detecting member is always in contact with said image heating belt member.

* * * * *